US010604941B2

(12) United States Patent
Schneider et al.

(10) Patent No.: US 10,604,941 B2
(45) Date of Patent: Mar. 31, 2020

(54) SPRING ACTION CLIP FOR BALUSTERS

(71) Applicant: BARRETTE OUTDOOR LIVING, INC., Middleburg Heights, OH (US)

(72) Inventors: Christopher Michael Schneider, Mays Landing, NJ (US); Wayne Elbert Dixon, Chuckey, TN (US); Michael Matthew DeSalle, Northfield, NJ (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 357 days.

(21) Appl. No.: 15/463,151

(22) Filed: Mar. 20, 2017

(65) Prior Publication Data

US 2018/0266119 A1 Sep. 20, 2018

(51) Int. Cl.

*E04F 11/18* (2006.01)
*E04H 17/14* (2006.01)
*E04H 17/00* (2006.01)

(52) U.S. Cl.

CPC ..... *E04F 11/1817* (2013.01); *E04F 11/1834* (2013.01); *E04F 11/1836* (2013.01); *E04F 11/1842* (2013.01); *E04H 17/1443* (2013.01); *E04F 2011/1821* (2013.01); *E04F 2011/1827* (2013.01); *E04H 2017/006* (2013.01); *E04H 2017/1452* (2013.01)

(58) Field of Classification Search

CPC ..... E04F 11/1817; E04F 11/1834; E04F 11/1842; E04F 2011/1827; E04F 2011/1825; E04F 2011/1823; E04H 17/1439; E04H 17/1417; E04H 17/1426

USPC ..... 256/65.01, 67

See application file for complete search history.

(56) References Cited

U.S. PATENT DOCUMENTS 5,882,001 A * 3/1999 Reinbold ..... E04H 17/003 256/22
6,971,831 B2 * 12/2005 Fattori ..... F16B 21/082 411/508
7,147,212 B2 12/2006 Platt
7,178,791 B1 2/2007 Gray, Jr. et al.

(Continued)

OTHER PUBLICATIONS

RDI, "Resalite Railing", Nov. 26, 2015, retrieved on Mar. 15, 2017 from http://www.rdirail.com/products/resalite-railing.html, 1 Page.

(Continued)

*Primary Examiner* — Matthieu F Setliff

(74) *Attorney, Agent, or Firm* — John Maldian; Maldjian Law Group LLC

(57) ABSTRACT

A railing system includes an upper rail and a lower rail spaced from the upper rail. The railing system also includes a plurality of balusters positioned between the upper rail and the lower rail. The railing system further includes a clip configured to attach one baluster of the plurality of balusters to the lower rail or the upper rail. The clip includes a baluster engagement portion configured to be received within an open end of the one baluster. The clip further includes a tab extending from the baluster engagement portion. The tab includes a fin portion configured to be inserted within one aperture of a plurality of apertures of the upper rail or the lower rail. The tab also includes a spring portion coupled to the fin portion. The spring portion is configured to secure the clip to the upper rail or the lower rail.

19 Claims, 21 Drawing Sheets

(56) References Cited

U.S. PATENT DOCUMENTS

| | | | | |
|---|---|---|---|---|
| 7,475,870 | B2 | 1/2009 | Platt | |
| 7,681,866 | B2 | 3/2010 | Lehmann | |
| 7,744,065 | B2 | 6/2010 | Terrels et al. | |
| D667,964 | S | 9/2012 | Chung | |
| 8,936,233 | B1 | 1/2015 | Sneith | |
| 9,027,909 | B1 * | 5/2015 | Peyton | E04H 17/1439 256/67 |
| 9,169,651 | B1 | 10/2015 | Wynne | |
| 9,234,368 | B2 * | 1/2016 | Zhu | F16B 7/0446 |
| 9,556,641 | B2 * | 1/2017 | Milanowski | E04H 17/1443 |
| 9,637,932 | B2 * | 5/2017 | Schneider | E04F 11/1834 |
| 2004/0208728 | A1 * | 10/2004 | Fattori | F16B 21/082 411/508 |
| 2005/0211969 | A1 * | 9/2005 | Graber | E04H 17/1443 256/65.08 |
| 2005/0285091 | A1 * | 12/2005 | Ko | E04H 17/1443 256/24 |
| 2007/0246698 | A1 | 10/2007 | Truckner et al. | |
| 2009/0212271 | A1 | 8/2009 | Platt | |
| 2009/0272957 | A1 | 11/2009 | Nelson et al. | |
| 2010/0237309 | A1 | 9/2010 | Ferris et al. | |
| 2011/0073824 | A1 | 3/2011 | Lappin et al. | |
| 2015/0115214 | A1 | 4/2015 | Schneider et al. | |
| 2015/0184419 | A1 * | 7/2015 | Zhu | F16B 7/0446 256/66 |
| 2015/0292234 | A1 | 10/2015 | Burt et al. | |
| 2016/0160525 | A1 * | 6/2016 | Milanowski | E04H 17/1443 256/65.12 |
| 2017/0234016 | A1 * | 8/2017 | Schneider | E04F 11/1834 256/67 |

OTHER PUBLICATIONS

Carolina Stair Supply, "Rail Zip Clip", Oct. 4, 2015, retrieved on Mar. 15, 2017 from http://www.carolinastair.com/Information.php?Rail-Zip-Clip-5, 16 Pages.

* cited by examiner

400

600

700

700

SPRING ACTION CLIP FOR BALUSTERS

FIELD OF THE INVENTION

Embodiments of the present disclosure generally relate to a railing system having a plurality of balusters connected to one or more rails. In particular, embodiments relate to a railing system having a clip with spring action to couple at least one baluster to a rail of the railing system.

BACKGROUND

Railing systems are used extensively for a variety of functional purposes, for example, as fencing to secure people, animals, and land, and to prevent entry into or exit from a specified area. Railing systems also may have aesthetic purposes, for example, on decks and around yards, stairway, terraces, and gardens. Railing systems often include at least one horizontal rail affixed to at least one vertical post, and optionally a plurality of balusters.

Consumers often have a preference regarding aesthetic features, such as color of a rail or a rail topper, apparent texture (e.g., matte, faux wood, etc.), shape, materials (e.g. vinyl, wood, iron, metal, etc.), etc. Stocking all possible combinations of aesthetic features that a manufacturer offers may be expensive for a retailer. Balusters that rest insecurely within their rails do not provide a desired aesthetic to consumers, and may be unsafe.

Railing systems generally may include a bottom rail, a top rail and pickets (e.g., balusters) mounted vertically therebetween. The top and bottom rails may include hor-izontally extending sections and angled sections, such as for steps or inclined ground. Typically, apertures are cut into the opposing surfaces of the bottom rail and top rail so as to receive ends of the pickets. The installer must estimate the size of the aperture to be cut into the rails, which may be not only be time consuming and inefficient, but also difficult if the pickets are installed at an angle to the rail. Also, because of cutting toler-ances, the pickets may not be tightly received in the railing and resulting in a less dura-ble, weaker railing system than if there were a tight fit. Further, the pickets have portions extending into the rails and thus, are longer than what is actually needed, resulting in added shipping costs and material costs.

For the foregoing reasons, there is a need for an apparatus that will allow for an efficient assembly of horizontal and angled sections of railing systems. There is a further a need for an apparatus that is aesthetic pleasing, and enhances the strength and durability of such structures while reducing shipping and material costs.

SUMMARY

Embodiments disclosed herein relates to a clip for coupling a baluster to a rail of a railing system. More specifically, the embodiments disclose herein relates to a clip that enables both a vertical orientation and an angular orientation of the baluster relative to the rail.

The railing system, as disclosed by the present disclosure, can be advantageously combined with the traditional railing system to offer a completely different look to the railing. Multiple styles may be offered for sale by a retailer, without devoting separate bay space to each possible combination of rail and deck board topping. The railing system can be retrofitted with existing railings purchased previously by customers. Once installed, the railing system provides secure attachment of rails to the balusters.

As disclosed by the present disclosure, the railing system may include an elongated rail with a plurality of apertures. The railing system also includes a plurality of clips configured to be inserted within the plurality of apertures, those apertures having a ridge that secures the clip to the rail. The clip includes a spring portion configured to fixedly attach the clip to the rail. The clips are further configured to couple a plurality of balusters to the elongated rail.

Embodiments, in accordance with the present invention, are directed to a railing system. The railing system includes an upper rail comprising a planar surface. The planar surface of the upper rail includes a plurality of apertures. The railing system also includes a lower rail spaced from the upper rail and comprising a planar surface. The planar surface of the lower rail also includes a plurality of apertures. The railing system further includes a plurality of balusters positioned between the upper rail and the lower rail. The railing system also includes a clip configured to attach one baluster of the plurality of balusters to the lower rail or the upper rail. The clip includes a baluster engagement portion configured to be received within an open end of the one baluster. The baluster engagement portion is configured to be seated on the planar surface of the lower rail or the upper rail. The clip also includes a tab extending from the baluster engagement portion. The tab includes a fin portion configured to be inserted within one aperture of the plurality of apertures of the upper rail or the lower rail. Further, the fin portion has a first end surface and a second end surface opposite to the first end surface. The first end surface has a curvilinear shape to allow rotation of the clip between a first position and a second position relative to the upper rail or the lower rail. The tab also includes a spring portion coupled to the fin portion. The spring portion extends partially between the first end surface and the second end surface so that the clip is rotatable between the first position and the second position. Further, the spring portion is configured to secure the clip to the upper rail or the lower rail upon insertion of the fin portion by at least a predetermined distance within the one aperture.

Embodiments in accordance with the present invention are further directed to a railing system. The railing system includes a rail comprising a planar surface. The planar surface of the rail includes at least one aperture. The railing system also includes a clip configured to attach a baluster to the rail. The clip includes a baluster engagement portion configured to be received within an open end of the baluster. The baluster engagement portion is configured to be seated on the planar surface of the rail. The clip also includes a tab extending from the baluster engagement portion. The tab includes a fin portion configured to be inserted within the at least one aperture of the rail. The fin portion has a first end surface and a second end surface opposite to the first end surface. The first end surface has a curvilinear shape to allow rotation of the clip between a first position and a second position relative to the rail. The tab also includes a spring portion coupled to the fin portion. The spring portion extends partially between the first end surface and the second end surface so that the clip is rotatable between the first position and the second position. Further, the spring portion is configured to secure the clip to the rail upon insertion of the fin portion by at least a predetermined distance within the at least one aperture.

Embodiments in accordance with the present invention further provide a clip for attaching a baluster to a rail. The clip includes a baluster engagement portion configured to be received within an open end of the baluster. The baluster engagement portion includes a mounting surface configured to be seated on a planar surface of the rail. The clip also includes a tab extending from the baluster engagement portion. The tab includes a fin portion configured to be inserted within an aperture of the rail. The fin portion has a first end surface and a second end surface opposite to the first end surface. Further, the first end surface has a curvilinear shape to allow rotation of the clip between a first position and a second position relative to the rail. The tab also includes a spring portion coupled to the fin portion. The spring portion extends partially between the first end surface and the second end surface so that the clip is rotatable between the first position and the second position. The spring portion is configured to secure the clip to the rail upon insertion of the fin portion by at least a predetermined distance within the aperture.

Embodiments of the present disclosure may provide several advantages depending on their configuration. It is an object of the present disclosure to provide a railing system, a railing kit, a method for assembling the railing system, which simplify an on-site assembly of a railing, enhance safety during the on-site assembly, and improve the aesthetic appeal of the railing in the assembled state.

These and other advantages will be apparent from the present application of the embodiments described herein.

The preceding is a simplified summary to provide an understanding of some embodiments of the present disclosure. This summary is neither an extensive nor exhaustive overview of the present disclosure and its various embodiments. The summary presents selected concepts of the embodiments of the present disclosure in a simplified form as an introduction to the more detailed description presented below. As will be appreciated, other embodiments of the present disclosure are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1:
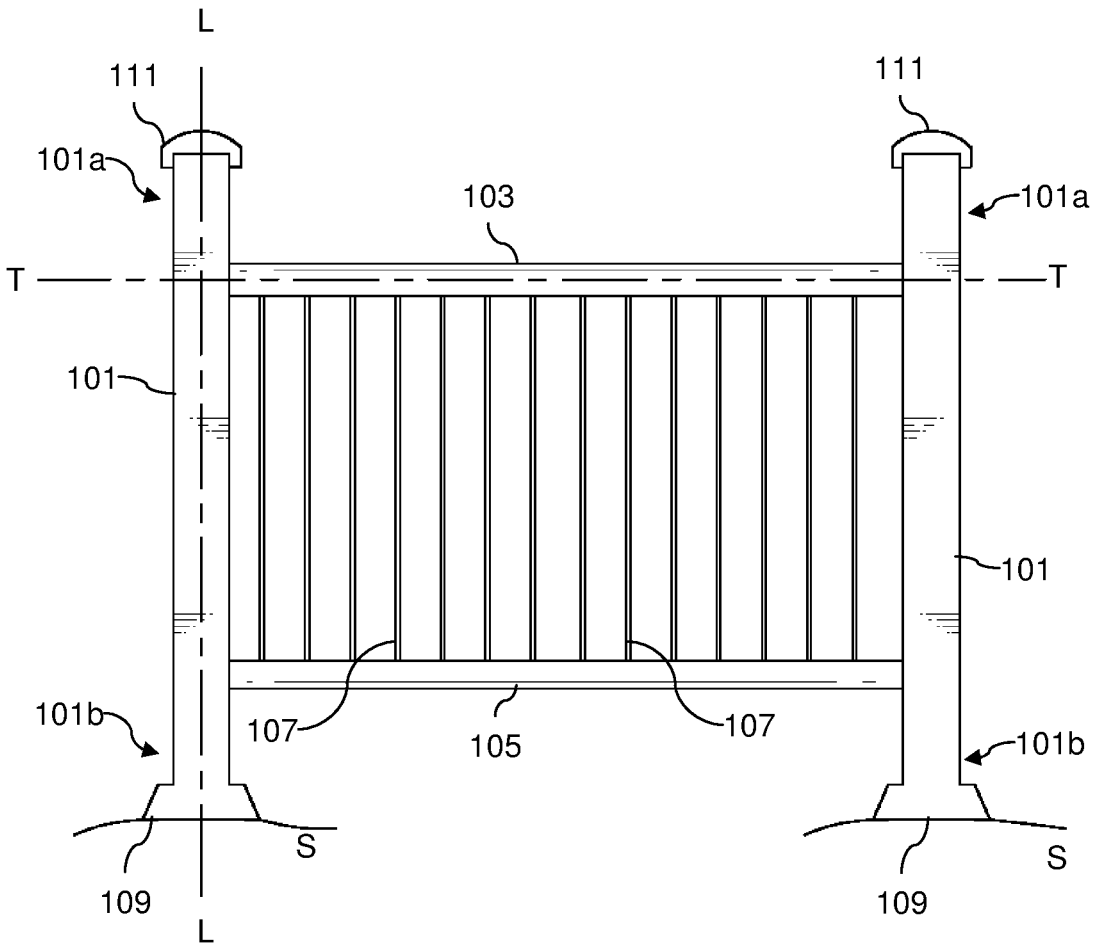
FIG. 1 illustrates a side view of a railing system, in accordance with an embodiment of the present disclosure.

While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the particular form disclosed, but to the contrary, the present disclosure is to cover all modification, equivalents, and alternatives falling within the spirit and scope of embodiments of the present disclosure as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure will be described below in conjunction with exemplary railing systems. Those skilled in the art will recognize the disclosed techniques may be used in building any railing that may be aesthetically pleasing.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1 illustrates a side view of a railing system 100, in accordance with an embodiment of the present disclosure. The railing system 100 can be installed in any outdoor region, including, but not limited to, yards, lawns, gardens, outdoor decks, porches, stairways, and the like. Railing system 100 also can be installed at indoor locations, e.g., along an indoor stairway, an indoor balcony, or an arena mezzanine edge, as a gate to limit child or pet access, and so forth. The railing system 100 includes a pair of posts 101, an upper rail 103, a lower rail 105, and a plurality of balusters 107.

The pair of posts 101 may be anchored to a solid surface, such as a side of a building, or may be sunk into a ground surface "S", or bolted to a flooring for support. In an exemplary embodiment, the pair of posts 101 may be flush on the ground surface "S" and supported by a post base 109. Further, the posts 101 are substantially stationary with respect to the ground surface "S". Each of the posts 101 may have a hollow elongate structure having a longitudinal major axis "L". Each of the posts 101 may further include a top longitudinal opening (not shown in FIG. 1), which is closed by a cap 111. Alternatively, each of the posts 101 may have a solid configuration. Each of the posts 101 also has a top end 101*a* and a bottom end 101*b*.

Further, a pair of mounts (not shown in FIG. 1) is coupled to each of the pair of posts 101. One of the pair of mounts is positioned proximate to the top end 101*a* of the posts 101, while the other is positioned proximate to the bottom end 101*b*. In some embodiments, the pair of mounts may be coupled to the respective posts 101 via one or more mechanical fasteners, an adhesive, a mechanical joint, or a combination thereof. Alternatively, the pair of mounts can be coupled to the respective posts 101 by various methods such as, but not limited to, welding, brazing, and the like. In some embodiments, the pair of mounts are inserted within a pair of rails. Therefore, the pair of mounts are hidden from outside, and not viewable in FIG. 1. The mounts couple the upper rail 103 and the lower rail 105 to the respective posts 101. In some embodiments, the pair of mounts enable the upper rail 103 and the lower rail 105 to be positioned at one or more angular orientations relative to the respective posts 101.

The upper rail 103 and the lower rail 105 extend between the posts 101 and are spaced apart along the longitudinal axis "L". The upper rail 103 and the lower rail 105 extend along a transverse axis "T", which is substantially perpendicular to the longitudinal axis "L". Further, each of the upper rail 103 and the lower rail 105 may have a planar surface (not shown in FIG. 1). In an embodiment, the planar surface of each of the upper rail 103 and the lower rail 105 includes a plurality of apertures (not shown in FIG. 1).

The railing system 100 further includes a plurality of clips (not shown in FIG. 1). Each of the plurality of clips is configured to be inserted within each of the plurality of apertures of the upper rail 103 and the lower rail 105. The plurality of clips is further configured to attach the plurality of balusters 107 to the upper rail 103 and the lower rail 105.

The balusters 107 are disposed between and coupled to the upper rail 103 and the lower rail 105. In some embodiments, the balusters 107 are coupled to the upper rail 103 and the lower rail 105 through the plurality of clips. In a further embodiment, one or more U-channels (not shown) also may be provided on the posts 101 in order to couple the posts 101 to adjacent balusters 107. The balusters 107 may have a closed top, an open top, or a lattice top. Each of the balusters 107 may have a substantially flat hollow structure. Further, the balusters 107 may have any suitable cross-section, for example, but not limited to, rectangular, square, polygonal, oval, circular, elliptical, and so forth. In an alternate embodiment, an adapter rail also may be coupled to the upper rail 103 and/or the lower rail 105 to support the balusters 107.

In some embodiments, the pair of posts 101, the upper rail 103, the lower rail 105 and the plurality of balusters 107 may be made of various materials such as, but not limited to, a composite material, aluminum, plastics, acrylics, glass, and so forth. Further, various techniques may be used to manufacture the components of the railing system 100 such as, but not limited to, extrusion, molding, casting, machining, and so forth.

Figure 2:
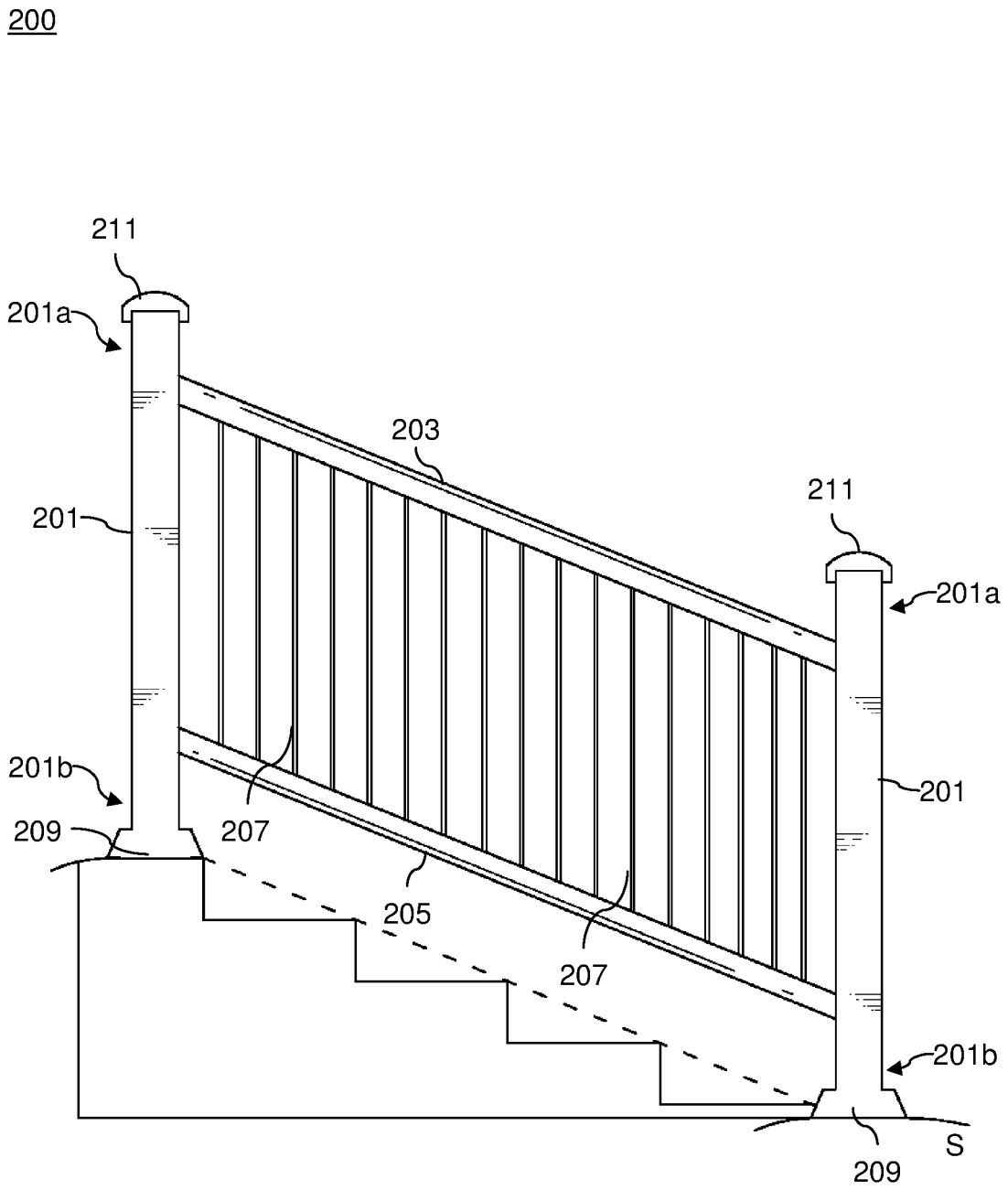
FIG. 2 illustrates a side view of a railing system, in accordance with another embodiment of the present disclosure.

FIG. 2 illustrates a side view of a railing system 200, in accordance with another embodiment of the present disclosure. The railing system 200, as illustrated in FIG. 2, can be used as a stairway railing, a ramp railing, or any other railing for a sloped surface. The railing system 200 includes a pair of posts 201, an upper rail 203, a lower rail 205 and a plurality of balusters 207. Further, a pair of mounts (not shown) is coupled to each of the pair of the posts 201. The pair of mounts is configured to enable the upper rail 203 and the lower rail 205 to be positioned at one or more angular orientations relative to the posts 201. Further, one of the pair of mounts is positioned proximate to a top end 201*a* of the posts 201, while the other is positioned proximate to the bottom end 201*b*. In some embodiments, the pair of mounts may be coupled to the respective posts 201 via one or more mechanical fasteners, an adhesive, a mechanical joint or a combination thereof. Alternatively, the pair of mounts can be coupled to the respective posts 201 by various methods such as, but not limited to, welding, brazing, and the like. In some embodiments, the pair of posts 201 may be supported by a post base 209. In some other embodiments, each of the posts 201 may surround a respective top longitudinal opening (not shown in FIG. 2), which is closed by a cap 211.

Each of the upper rail 203 and the lower rail 205 may include a planar surface (not shown in FIG. 2) having a plurality of apertures. The railing system 200 also includes a plurality of a clips (not shown in FIG. 2) configured to be inserted within the plurality of apertures. The plurality of balusters 207 are coupled to the upper rail 203 and the lower rail 205 via the plurality of clips. The clips enable the plurality of balusters 207 to be positioned at one or more angular orientations relative to the upper rail 203 and the lower rail 205.

In some embodiments, the railing systems 100, 200 also may include interior chases or passages for installation of wires, cables and the like.

The components of the railing system 100 and 200 may be part of a kit that is assembled on-site. The railing system 100, 200, as described above, are purely exemplary in nature, and various alternatives can be envisioned within the scope of the present disclosure.

Figure 3:
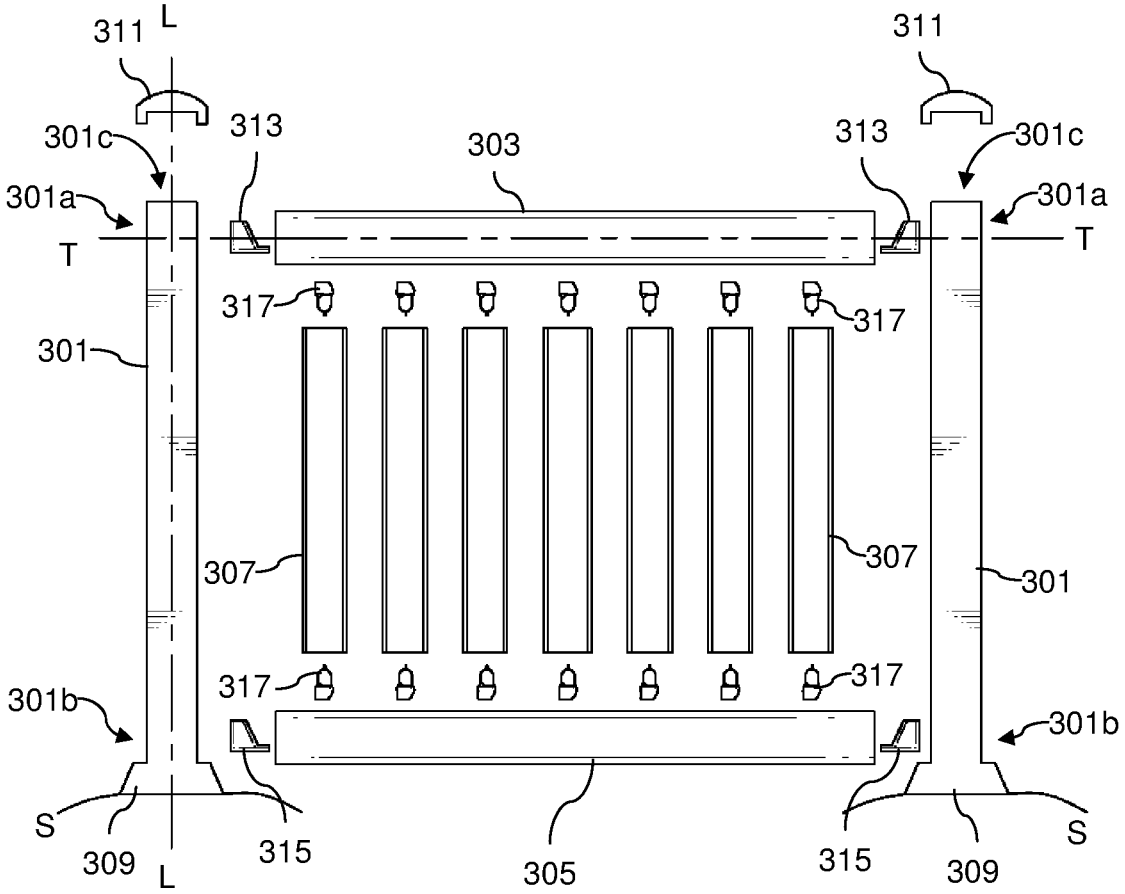
FIG. 3 is an exploded view of the railing system, in accordance with an embodiment of the present disclosure.

FIG. 3 illustrates an exploded view of a railing system 300, in accordance with an embodiment of the present disclosure. The railing system 300 includes a pair of posts 301, an upper rail 303, a lower rail 305 and a plurality of balusters 307. The railing system 300 further includes a pair of caps 311, a pair of upper mounts 313, a pair of lower mounts 315 and a plurality of the clips 317.

Each of the pair of the posts 301 may have a hollow elongate structure having the longitudinal major axis "L". Each of the posts 301 may further include a top longitudinal opening 301*c*, which a closed by a cap 311. In some embodiments, the cap 311 is configured to be coupled to the post 301 through friction fit. In some other embodiments, the cap 311 is configured to be coupled to the post 301 by any suitable fastening method, such as, but not limited to, an adhesive, one or more mechanical fasteners, or a combination thereof.

In some embodiments, the railing system 300 also includes a pair of post bases 309. The post bases 309 support the corresponding posts 301 on the ground surface "S". The post bases 309 also may be partially embedded within the ground. Further, the post bases 309 enable the posts 301 to remain substantially stationary with respect to the ground surface "S".

The pair of upper mounts 313 and the pair of lower mounts 315 are configured to be coupled to the respective posts 301. Each of the upper mounts 313 is positioned proximate to a top end 301*a* of the respective posts 301, while each of the lower mounts 315 is spaced apart from the corresponding upper mounts 313 and is positioned proximate to a bottom end 301*b* of the respective posts 301. Further, the upper mounts 313 and the lower mounts 315 are configured to support the upper rail 303 and the lower rail 305, respectively, between the posts 301. The upper mounts 313 and the lower mounts 315 may be coupled to the posts 101 via one or more mechanical fasteners, an adhesive, a mechanical joint or a combination thereof. Alternatively, the upper mounts 313 and the lower mounts 315 may be coupled to the posts 301 by various methods such as, but not limited to, welding, brazing, and the like.

The upper rail 303 and the lower rail 305 are configured to be disposed between and coupled to the pair of posts 301. The upper rail 303 and the lower rail 305 are supported by the upper mounts 313 and the lower mounts 315, respectively. Further, the upper rail 303 and the lower rail 305 may be coupled to the upper mounts 313 and the lower mounts 315, respectively, through friction fit, an adhesive or a combination thereof. Further, each of the upper rail 303 and the lower rail 305 may include a plurality of apertures (not shown in FIG. 3), the plurality of apertures being configured to receive the plurality of clips 317.

The clips 317 are further configured to attach the plurality of balusters 307 to the upper rail 303 and the lower rail 305. The clips 317 are configured to be attached to the plurality of the balusters 307 through friction fit, an adhesive, a mechanical joint, mechanical fasteners, or a combination thereof. In an alternative embodiment, the clips 317 enable the balusters 307 to be positioned at a plurality of angular orientations relative to the upper rail 303 and the lower rail 305. In some embodiments, the clips 317 may be manufactured from various materials such as, but not limited to, plastic, glass, metal, metallic alloys, acrylics, a composite material, and so forth. Further, the plurality of clips 317 may be manufactured using various techniques such as, but not limited to, molding, extrusion, casting, machining, and so forth.

The balusters 307 may have a closed top, an open top or a lattice top. Each of the balusters 307 may have substantially flat hollow structures. Further, the balusters 307 may have any suitable cross-section, for example, but not limited to, rectangular, square, polygonal, oval, circular, elliptical, and so forth. The balusters 307 may abut with each other or a clearance may be provided between them.

Various components of the railing system 300 may facilitate the installation of railing system 300 at a plurality of angular orientations, such as installation at level-railing, installation at non-level or angular railing and so forth. Further, level-railing installation is when the angle of installation of a railing system is approximately zero with reference to the installation surface. Moreover, non-level or angular railing is when the angle of a railing system is greater than zero such as, in case of a staircase railing.

Figure 4A:
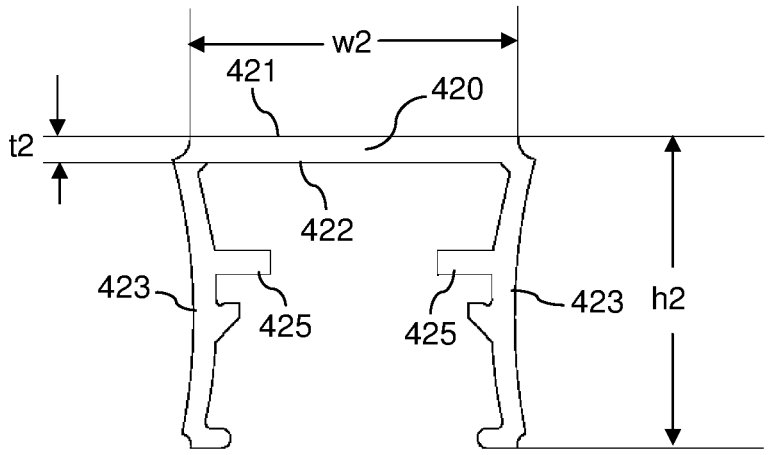
FIG. 4A is a front view of a rail, in accordance with an embodiment of the present disclosure.
Figure 4B:
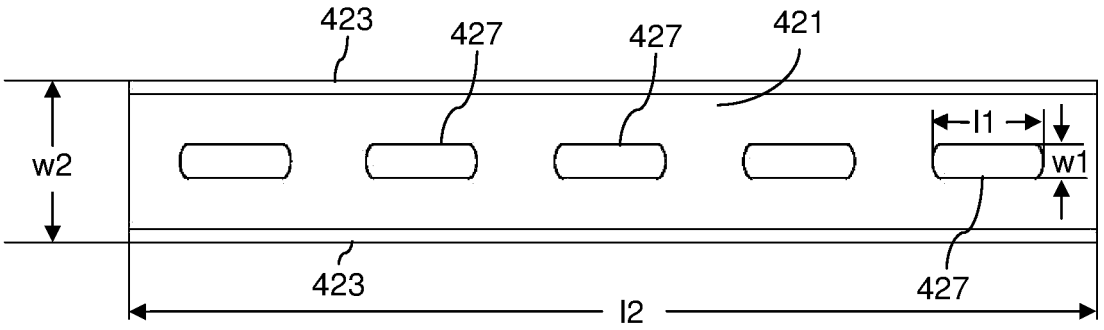
FIG. 4B is a top view of the rail illustrated in FIG. 4A.

FIGS. 4A and 4B illustrate a front view and a top view of a rail 400, respectively. The rail 400 may have a similar structure as that of the upper rail 303 and the lower rail 305, as shown in FIG. 3. The rail 400 includes a wall 420 having a planar surface 421 and a bottom surface 422, and a pair of lateral sides 423 extending from the wall 420 and spaced apart from each other. The pair of lateral sides 423 may have any suitable shape such as, but not limited to, curvilinear, planar, and so forth. The rail 400, as shown in FIGS. 4A and 4B, is open from both sides and further includes a lower opening formed between the pair of lateral sides 423. Alternatively, the rail 400 may have a wall (not shown) extending between the lateral sides 423 and opposite to the wall 420 such that the rail 400 is also closed on the lower side. As illustrated in FIG. 4A, the pair of lateral sides 423 may include multiple internal protrusions 425. The internal protrusions 425 are configured to secure the rail 400 to a mount (not shown in FIG. 4A). With reference to FIG. 3, the mount may be any of the upper mount 313 or the lower mount 315 depending on whether the rail 400 embodies the upper rail 303 or the lower rail 305, respectively. In some other embodiments, the internal protrusions 425 are configured to secure a rail top (not shown) to the rail 400. The rail top is configured to cover the lower opening of the rail 400.

As illustrated in FIG. 4B, the planar surface 421 may include a plurality of apertures 427. Each of the apertures 427 are configured to at least partly receive the clip 317 (shown in FIG. 3) that is configured to secure the corresponding baluster 307 (shown in FIG. 3) to the rail 400. Each of the apertures 427 may have a respective ridge around its edge such that the clip 317 may be secured thereon. Each of the apertures 427 may have a width "w1" and a length "l1". Each of the apertures 427 may have any suitable dimensions in order to receive at least a portion of the clip 317 within the rail 400. Further, referring to FIGS. 4A and 4B, the rail 400 may have a width "w2", a length "l2" and a height "h2". Wall 420 of rail 400 also may have a thickness "t2". In some embodiments, the width "w2", the length "l2" and the height "h2" may have any suitable values for installation of the rail 400 in a railing system, for example, the railing system 300 of FIG. 3. In some embodiments, each end of the rail 400 may be appropriately shaped to enable angular orientation of the rail 400 with respect to the posts 301 (shown in FIG. 3).

Figure 5A:
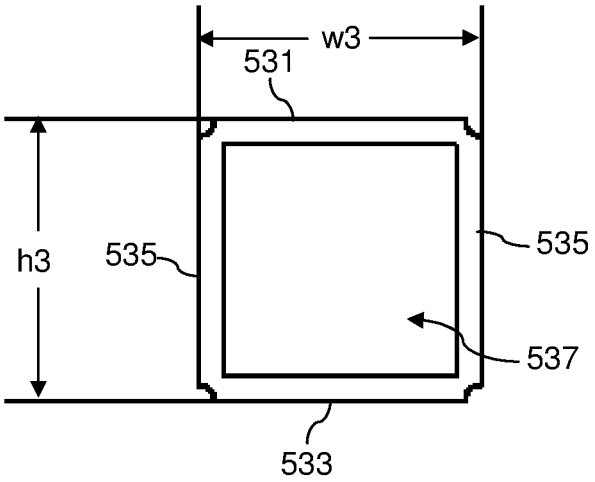
FIG. 5A is a front view of a baluster, in accordance with an embodiment of the present disclosure.
Figure 5B:
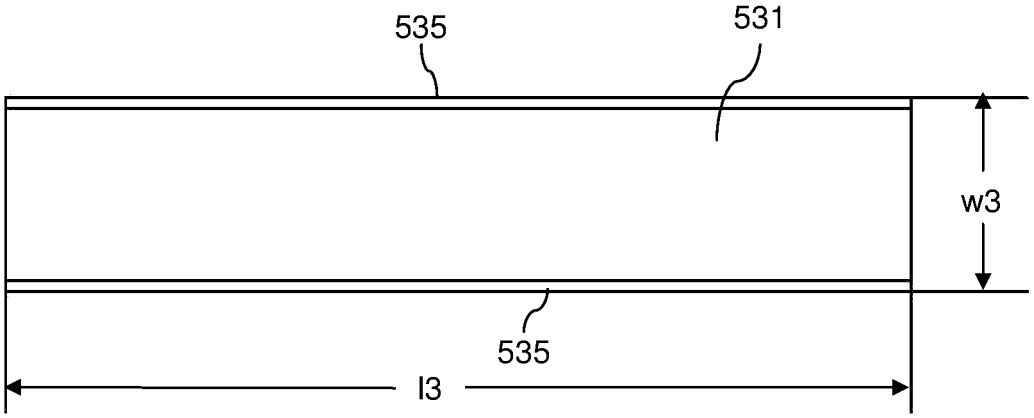
FIG. 5B is a top view of the baluster illustrated in FIG. 5A.

FIGS. 5A and 5B illustrate a front view and a top view of a baluster 500, respectively. The baluster 500 includes a top wall 531, a bottom wall 533 opposite to the top wall 531, and a pair of side walls 535 extending between the top wall 531 and the bottom wall 533. The top wall 531, the bottom wall 533, and the pair of side walls 535 together form an elongated hollow structure with an open end 537 on both sides. In the illustrated embodiment, the pair of side walls 535 are substantially parallel to each other. The top wall 531, the bottom wall 533 and the pair of side walls 535 may have any shape to provide a suitable cross-section to the baluster 500. For example, the top wall 531, the bottom wall 533 and the pair of side walls 535 may be curvilinear, rectangular, and so forth. Further, the baluster 500 may have rounded edges to prevent or reduce damage. In some embodiments, the baluster 500 is positioned to be substantially perpendicular to the upper rail 103 (shown in FIG. 1) and the lower rail 105 (shown in FIG. 1). In some other embodiments, the baluster 500 is positioned at an angle relative to the upper rail 203 (shown in FIG. 2) and the lower rail 205 (shown in FIG. 2). The angle may lie within any suitable range such as, but not limited to, between about 29 degrees to about 41 degrees. The baluster 500 also may have any cross-section, for example, but not limited to, rectangular, square, polygonal, oval, circular, elliptical, and so forth. In the illustrated embodiment, the baluster 500 has a width "w3", a length "l3" and a height "h3". Further, the baluster 500 may have stiffening ribs (not shown) that impart structural strength.

Figure 6A:
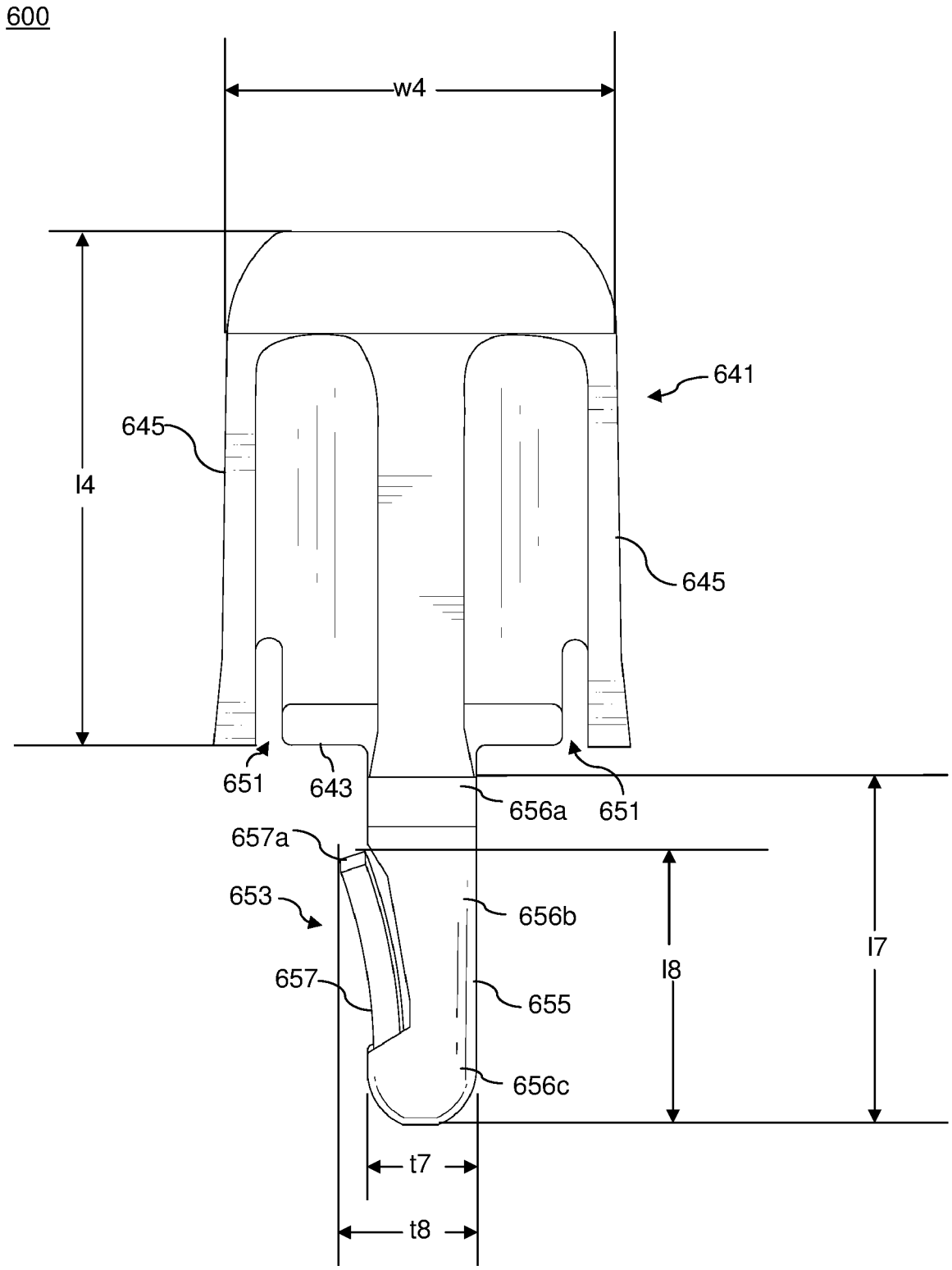
FIG. 6A is a front view of a clip, in accordance with an embodiment of the present disclosure.
Figure 6B:
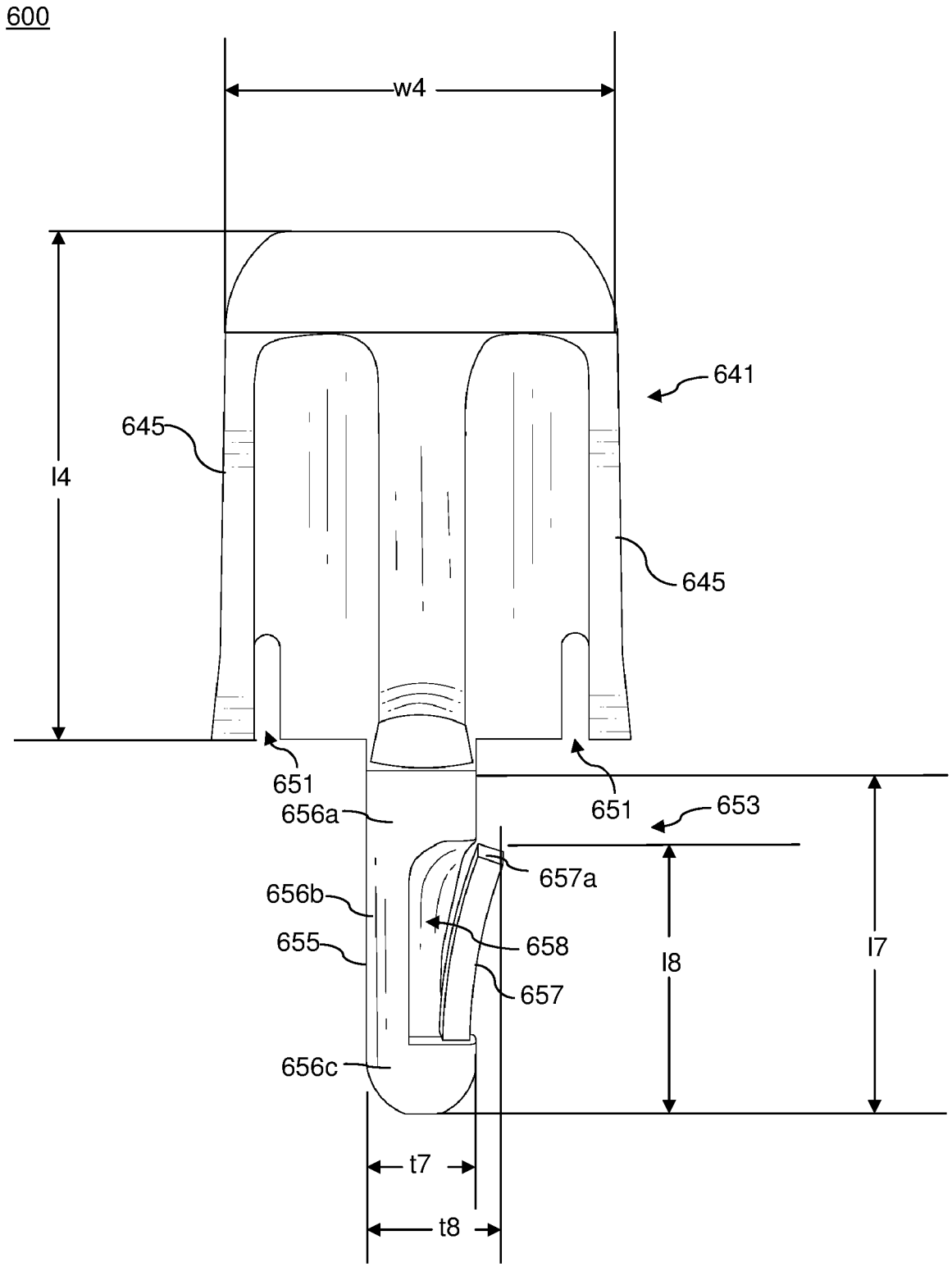
FIG. 6B is a rear view of the clip illustrated in FIG. 6A.
Figure 6C:
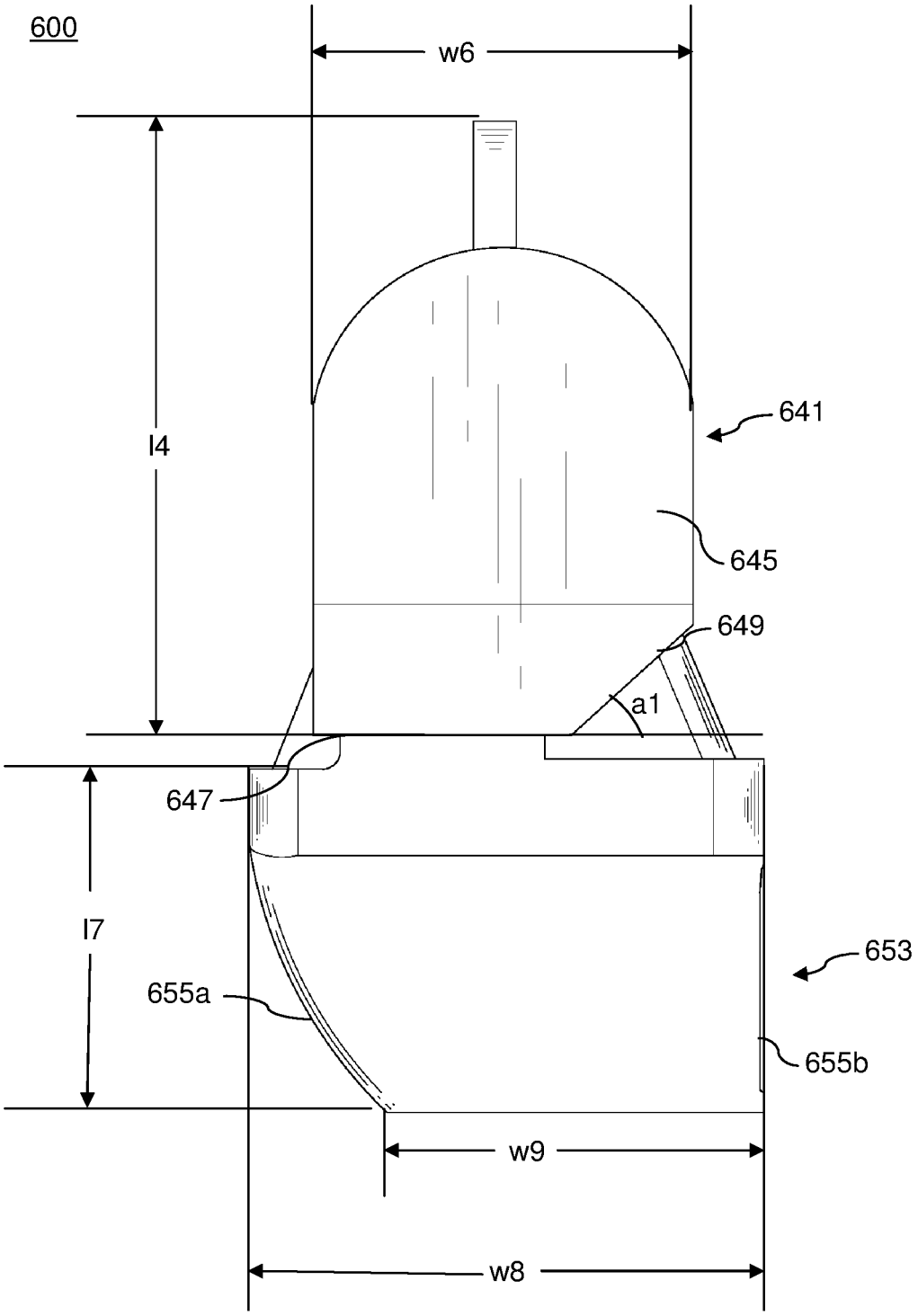
FIG. 6C is a right-side view of the clip illustrated in FIG. 6A.
Figure 6D:
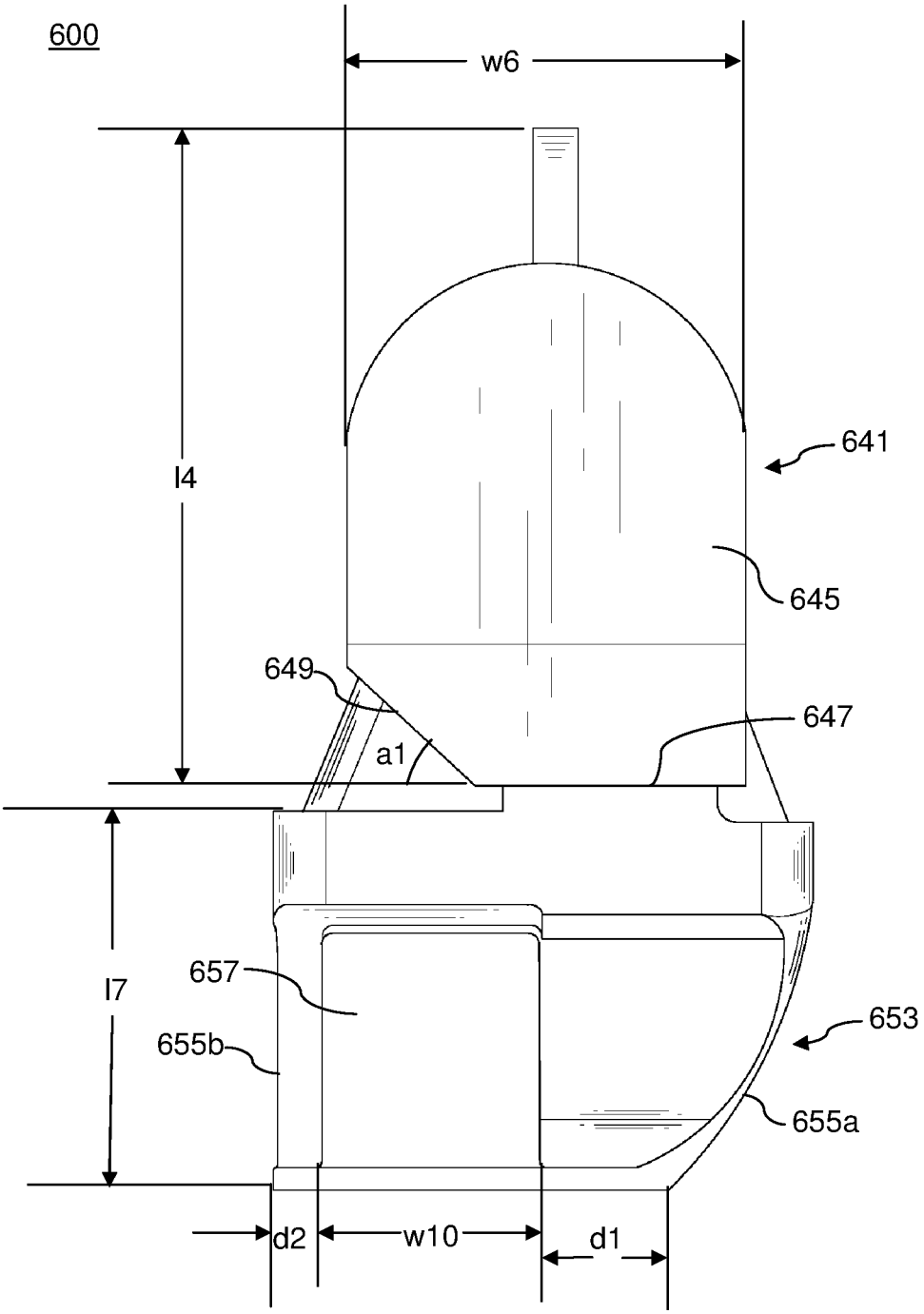
FIG. 6D is a left-side view of the clip illustrated in FIG. 6A.
Figure 6E:
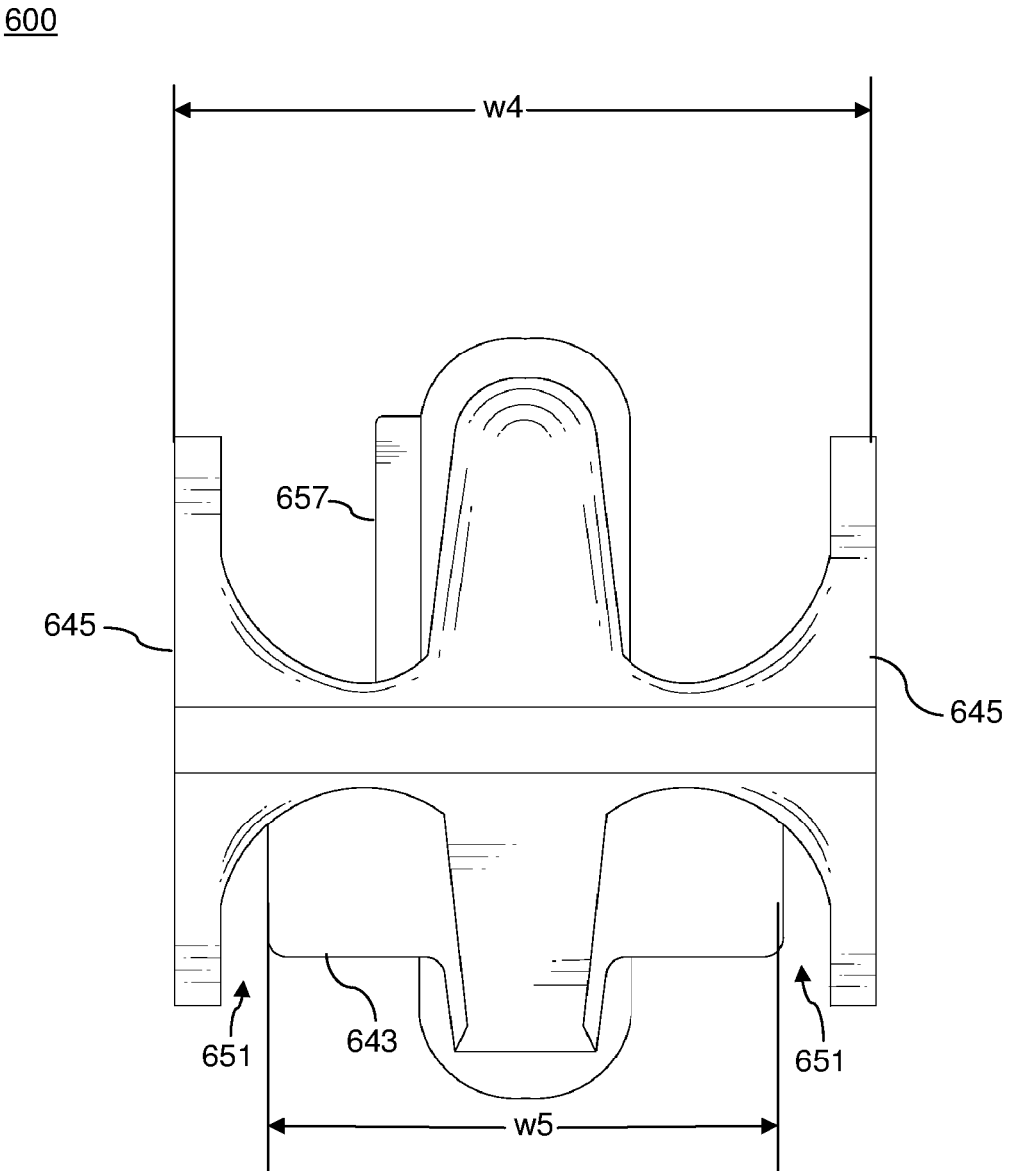
FIG. 6E is a top view of the clip illustrated in FIG. 6A.
Figure 6F:
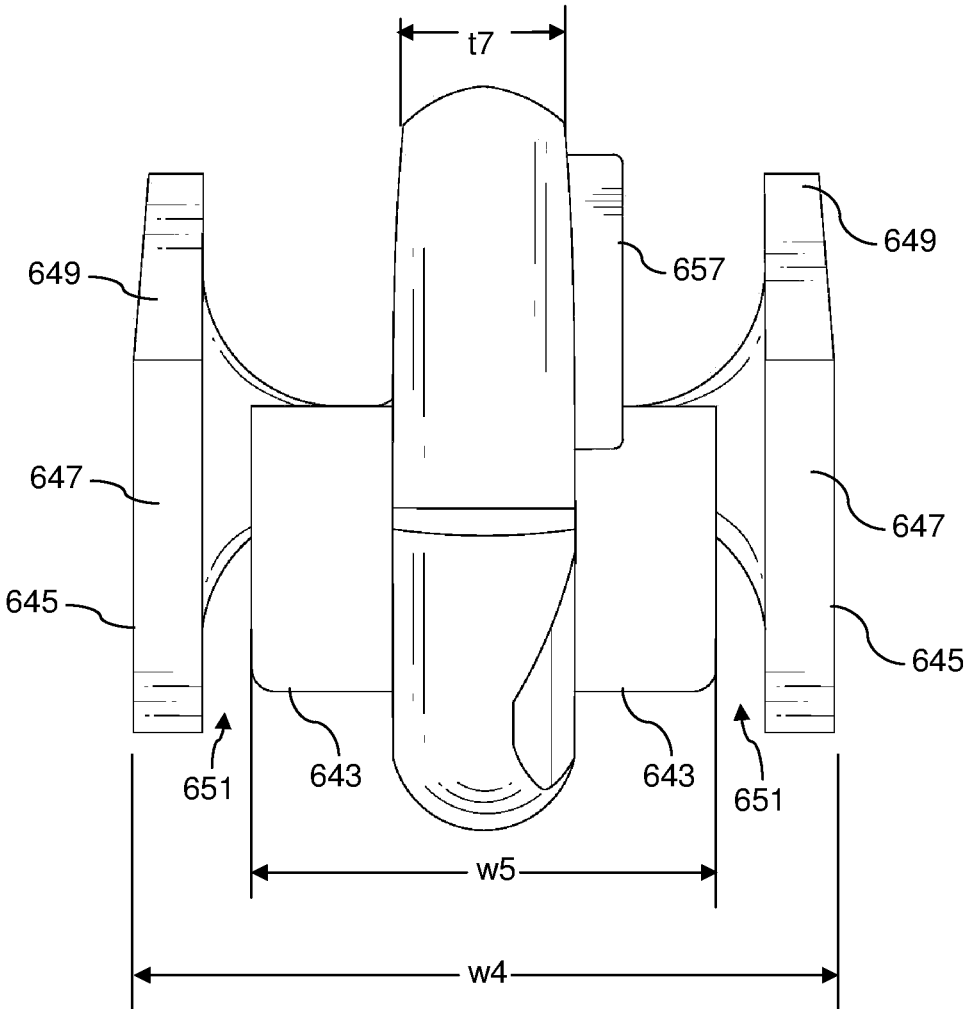
FIG. 6F is a bottom view of the clip illustrated in FIG. 6A.

FIG. 6A illustrates a front view of a clip 600. FIG. 6B illustrates a rear view of the clip 600. FIG. 6C illustrates a right-side view of the clip 600. FIG. 6D illustrates a left-side view of the clip 600. FIG. 6E illustrates a top view of the clip 600. FIG. 6F illustrates a bottom view of the clip 600. Referring to FIGS. 6A-6F, the clip 600 includes a baluster engagement portion 641 configured to be received within one of the open ends 537 of the baluster 500 (shown in FIG. 5A). The baluster engagement portion 641 is further configured to be seated on the planar surface 421 of the rail 400 (shown in FIG. 4B). In an illustrated embodiment, the baluster engagement portion 641 has a width "w4" and a length of "l4". The width "w4" of the baluster engagement portion 641 may be less than or equal to the width "w3" of the baluster 500 such that, in a coupled state, the baluster engagement portion 641 is located entirely within the baluster 500. The baluster engagement portion 641 includes a mounting surface 643. The mounting surface 643 may have a width "w5" that is greater than the width "w1" of each of the apertures 427 (as shown in FIG. 4B).

The baluster engagement portion 641 also includes a pair of support portions 645. The support portion 645 includes a first support surface 647 configured to support the baluster engagement portion 641 on the planar surface 421. The support portion 645 also includes a second support surface 649 extending from the first support surface 647. The second support surface 649 is inclined with respect to the first support surface 647. In the illustrated embodiment, the second support surface 649 is inclined at an angle "a1" with respect to the first support surface 647. In an embodiment, the angle "a1" may lie in a range from about 29 degrees to 41 degrees relative to the rail 400. Further, each of the first support surface 647 and the second support surface 649 is substantially planar. In other embodiments, at least one of the first support surface 647 and the second support surface 649 may be curved. In some embodiments, the support portions 645 are configured to be flush with the pair of side walls 535 of the baluster 500. Further, each of the support portions 645 may have a variable length and width throughout. In the illustrated embodiment, the support portion 645 has a maximum width "w6". Further, the maximum width "w6" is less than or approximately equal to the height "h3" of the baluster 500 such that the baluster engagement portion 641 can be completely inserted within the baluster 500. In some other embodiments, each of the support portions 645 may include multiple ribs that interface with the pair of side walls 535 of the baluster 500 to improve coupling between the baluster engagement portion 641 and the baluster 500.

The baluster engagement portion 641 further includes recesses 651 between the mounting surface 643 and each of the support portions 645. Multiple recesses may be used, in accordance with the geometry of baluster 500. The recesses 651 may allow ex-pansion or contraction of the support portions 645 or the mounting surface 643 that may occur due to temperature change. In some other embodiments, recesses 651 may allow flexing of the support portion 645 during the insertion of baluster engagement portion 641 into one of open ends 537 of baluster 500. In some embodiments, recesses 651 allow clip 600 to be wider than a respective opening in baluster 500, and permit tips of support portions 645 to flex inward during insertion. This creates a preload condition with interference (e.g., a mechanical stop) between clip 600 and baluster 500, thus providing precise placement as well as maintaining location during curing if an adhesive or other permanent fastening method had been used. Preloading also compensates for variation in opening dimensions of baluster 500, and allows installation of a rail (e.g., rail 400) without clip 600 disengaging from baluster 500 if clip 600 had not been secured perma-nently to baluster 500.

The clip 600 includes a tab 653 extending from the baluster engagement portion 641. In an embodiment, the tab 653 extends by a length "l7" from the mounting surface 643. The tab 653 includes a fin portion 655 that is configured to be inserted within one of the plurality of apertures 427. In some embodiments, the mounting surface 643 may prevent the insertion of the clip 600 into the aperture 427 beyond the tab 653. Specifically, the width "w5" of the mounting surface 643 is greater than the width "w1" of each of the apertures 427. Therefore, upon insertion of the tab 653 into the aperture 427 to a predetermined distance, the mounting surface 643 rests on the planar surface 421 and prevents further insertion of the clip 600 within the aperture 427. The predetermined distance may be less than or equal to the height "h2" of rail 400. Further, the predetermined distance may be substantially equal to the length "l7" of the tab 653. As such, the mounting surface 643 enables the baluster engagement portion 641 to be disposed on the planar surface 421 once the tab 653 is completely inserted within the rail 400. In some embodiments, the mounting surface 643 may support the clip 600 on the planar surface 421.

As illustrated in FIG. 6C, the fin portion 655 has a first end surface 655*a* and a second end surface 655*b* opposite to the first end surface 655*a*. In an exemplary embodiment, the first end surface 655*a* has a curvilinear shape to allow rotation of the clip 600 between a first position and a second position relative to the rail 400. Specifically, the first end surface 655*a* may be convex. The second end surface 655*b* is substantially straight. This may impede rotation of the clip 600 at the second end surface 655*b*. The first position and the second position are determined based on the application of the railing system 300 (shown in FIG. 3). The first position may correspond to a level-railing installation, while the second position may correspond to an angle railing installation. However, in various alternative embodiments, the first position and the second position may correspond to different angular installation. Specifically, the first position may correspond to a first oblique angle between the clip 600 and the planar surface 421 while the second position may correspond to a second oblique angle between the clip 600 and the planar surface 421. The tab 653 also includes a spring portion 657 coupled to the fin portion 655. The spring portion 657 extends partially between the first end surface 655*a* and the second end surface 655*b*. The fin portion 655 may have a maximum width "w8" proximate to the baluster engagement portion 641 and a minimum width "w9" distal to the baluster engagement portion 641. Further, the maximum width "w8" of the fin portion 655 is less than or approximately equal to the length "l1" (shown in FIG. 4B) of the aperture 427. The spring portion 657 may have a width "w10" that is less than the minimum width "w9" of the fin portion 655. Further, a minimum distance between the spring portion 657 and the first end surface 655*b* is "d1". A distance between the second end surface 655*b* and the spring portion is "d2". In an embodiment, the distance "d1" is greater than the distance "d2". Therefore, the spring portion 657 extends only partially between the first end surface 655*a* and the second end surface 655*b*. Further, the location of the spring portion 657 relative to the first end surface 655*a* and the second end surface 655*b* may facilitate rotation of the clip 600 between the first position and the second position.

The tab 653 may have variable width as the spring portion 657 has a curvilinear shape. Specifically, the spring portion 657 may curve away from the fin portion 655. In some embodiments, the spring portion 657 deforms (i.e., flexes) to provide a uniform thickness "t7" to the tab 653. The uniform thickness "t7" is less than or approximately equal to the width "w1" of the aperture 427 (as shown in FIG. 4B) and therefore allows the insertion of the tab 653 within the aperture 427. The spring portion 657 is further configured to secure the clip 600 to the upper rail 303 (shown in FIG. 3) or the lower rail 305 (shown in FIG. 3) upon insertion of the fin portion 655 by at least a predetermined distance within the one aperture 427 of the rail 400. The predetermined distance is equal to or less than the height "h2" of the rail 400. In some other embodiments, the predetermined distance may vary based on the angular orientation of the clip 600 relative to the rail 400. Further, after the insertion of the fin portion 655 to the predetermined distance, the spring portion 657 extends to a normal state, as shown in FIGS. 6A and 6B. The extension of the spring portion 657 to the normal state provides the tab 653 with a maximum thickness of "t8" that is greater than the width "w1" of aperture 427. Specifically, the spring portion 657 may curve away from the fin portion 755 to set the maximum thickness "t8" of the tab 653.

Further, the fin portion 655 includes an upper part 656*a* located adjacent to the mounting surface 643, a middle part 656*b* extending from the upper part 656*a* and a lower part 656*c* extending from the middle part 656*b*. A maximum thickness of the lower part 656*c* may be substantially equal to the uniform thickness "t7". Further, a thickness of the upper part 656*a* may be substantially equal to the width of the lower part 656*c*, i.e., the uniform thickness "t7". Therefore, the upper and lower parts 656*a*, 656*b* may be inserted within the aperture 427. Therefore, the spring portion 657 may prevent removal of the clip 600 from the aperture 427, thereby securing the clip 600 to the rail 400 as the uniform thickness "t7" is less than or approximately equal to the width "w1" of the aperture 427. The upper part 656*a* may have substantially planar edges along a length, and curved edges at both ends. Further, the lower part 656*c* may have a rounded end. The spring portion 657 extends from an upper surface of the lower part 656*c* towards the upper part 656*a*. In the illustrated embodiment, an upper edge 657*a* of the spring portion 657 is located at a distance "l8" relative to a bottom surface of the tab 653. In an embodiment, a difference between the length "l7" of the tab 653 and the distance "l8" may be less than or equal to the thickness "t2" of the wall 420 of the rail 400 (shown in FIG. 4A). In an embodiment, the predetermined distance, by which the tab 657 has to be inserted within the aperture 427 to secure the clip 600 to the rail 400, may be greater than or equal to the distance "l8". In a further embodiment, the predetermined distance may be less than or equal to the length "l7" of the tab 653. In yet another embodiment, the predetermined distance is greater than the distance "l8" and less than the length "l7". Therefore, upon insertion of the tab 653 within the aperture 427, the upper edge 657*a* may abut the bottom surface 422 of the wall 420, thereby securing the clip 600 to the rail 400. Further, the spring portion 657 also may prevent any undesired movement of the clip 600 once the baluster 500 (shown in FIGS. 5A and 5B) is secured to the baluster engagement portion 641.

Further, the middle part 656*b* has a curvilinear shape in order to accommodate the spring portion 657. Specifically, middle part 656*b* surrounds a recess 658 so that the spring portion 657 can move between the normal state and a deformed state.

The clip 600 may be formed by various manufacturing methods, such as molding, casting, machining, or a combination thereof. Various sections (for example, the baluster engagement portion 641, the fin portion 655, and the spring portion 657) of the clip 600 may be integrally formed, or can be manufactured separately and then assembled together.

Figure 7A:
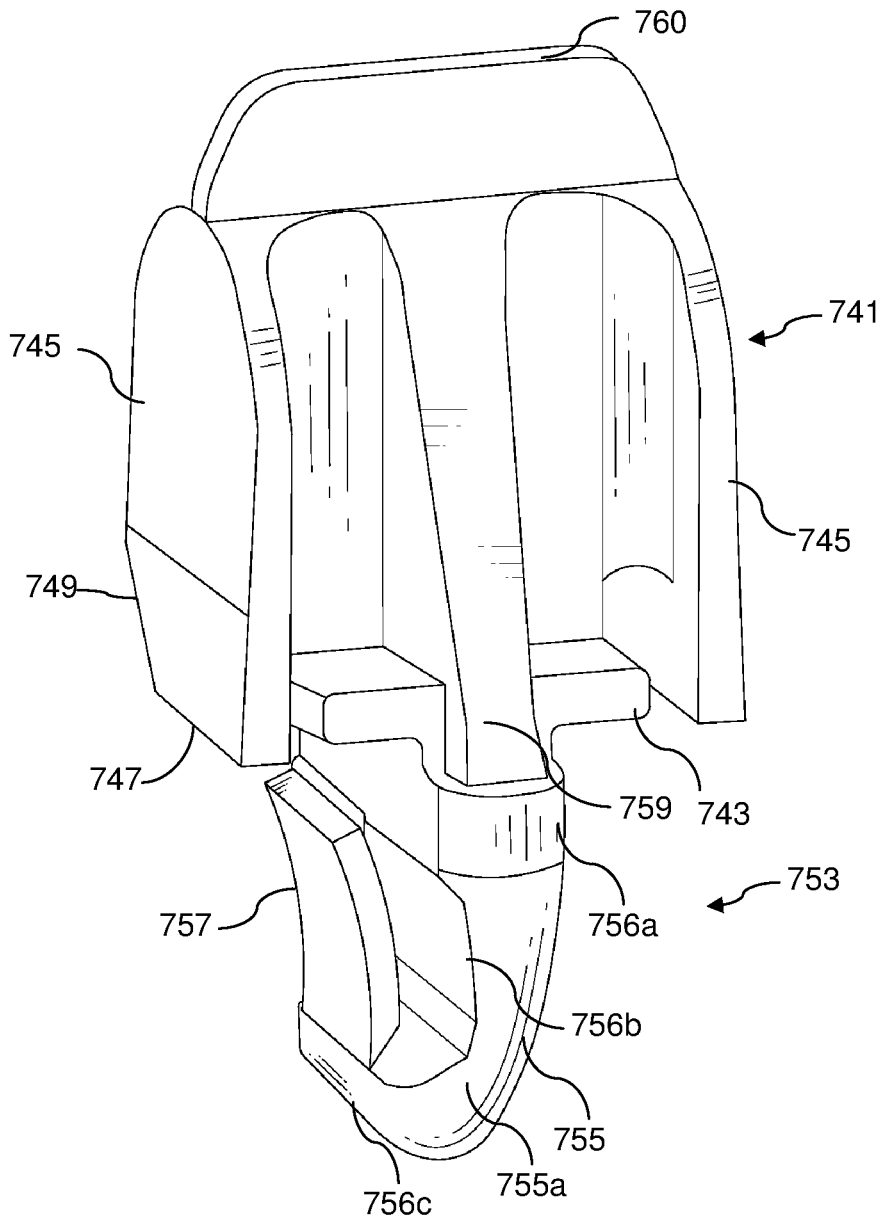
FIGS. 7A and 7B illustrate oblique views of a clip, in accordance with embodiments of the present disclosure.
Figure 7B:
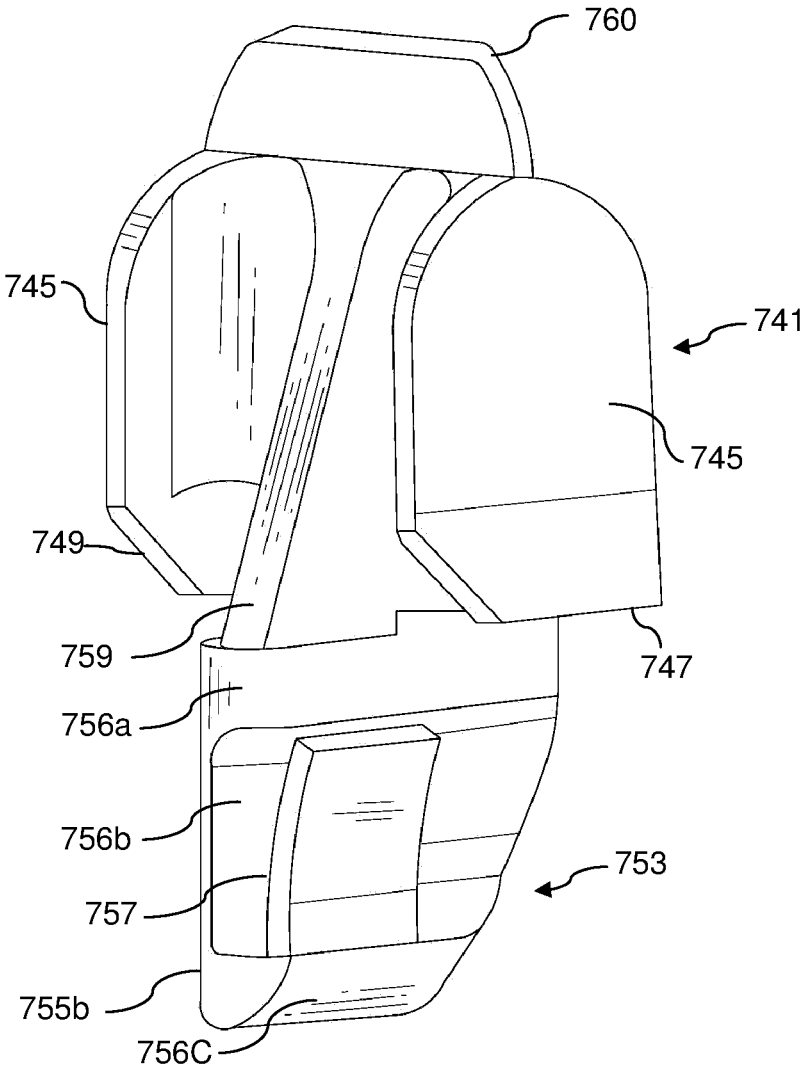

FIGS. 7A and 7B are oblique views of a clip 700, according to embodiments of present disclosure. As illustrated in FIG. 7A, the clip 700 includes a baluster engagement portion 741 configured to be received within the open end 537 of the baluster 500 (shown in FIG. 5A). The baluster engagement portion 741 includes a mounting surface 747 configured to be seated on the planar surface 421 of the rail 400 (shown in FIG. 4B) in a first position of the clip 700. The clip is in a first position when the mounting surface 743 is substantially parallel to the planar surface 421 such that the clip 700 is substantially perpendicular to the planar surface 421. The mounting surface 747 is inclined with respect to the planar surface 421 in a second position of the clip 700. The clip is in a second position when the clip 700 is positioned at an angle with respect to the planar surface 421 of the rail 400. The baluster engagement portion 741 also includes a pair of support portions 745. As illustrated in FIG. 7A and FIG. 7B, each of the support portions 745 includes a first support surface 747 configured to support the baluster engagement portion 741 on the planar surface 421. Further, each of the support portions 745 also includes a second support surface 749 extending from the first support surface 747. The second support surface 749 is inclined with respect to the first support surface 747. The second support surface 749 is configured to support the baluster engagement portion 741 on the planar surface 421 in the second position.

The clip 700 includes a tab 753 extending from the baluster engagement portion 741. The tab 753 includes a fin portion 755 that is configured to be inserted within one of the plurality of apertures 427 (shown in FIG. 4B). The fin portion 755 has a first end surface 755*a* and a second end surface 755*b* opposite to the first end surface 755*a*. In an exemplary embodiment, the first end surface 755*a* has a curvilinear shape to allow rotation of the clip 700 between the first position and the second position relative to the rail 400. The first and the second position are determined based on the application of the railing system 300 (as shown in FIG. 3). The fin portion 755 includes an upper part 756*a* located adjacent to the mounting surface 743, a middle part 756*b* extending from the upper part 756*a* and a lower part 756*c* extending from the middle part 756*b*. In some embodiments, the middle part 756*b* may have a curvilinear shape. The tab 753 also includes a spring portion 757 coupled to the fin portion 755. The spring portion 757 extends partially between the first end surface 755*a* and the second end surface 755*b*. Further, the spring portion 757 projects from the lower part 756*c* of the fin portion 755 towards the upper part 756*a*. The curvilinear shape of the middle part 756*b* may allow for deformation of the spring portion 757. The spring portion 757 is further configured to secure the clip 700 to the upper rail 303 or the lower rail 305 upon insertion of the fin portion 755 by at least a predetermined distance within the one aperture 427 of the rail 400. In some embodiments, the spring portion 757 moves towards the middle part 756*b* of the fin portion during the insertion of the fin portion 755 into the aperture 427 and returns to a normal state (as illustrated in FIGS. 7A and 7B) after complete insertion to secure the clip 700 to the rail 400. The predetermined distance is equal to or less than the height "h2" of the rail 400. In some other embodiments, the predetermined distance is determined based on the angular rotation of the rail 400.

In some embodiments, the baluster engagement portion 741 includes ribs 759 to impart strength and rigidity to the clip 700. Further, the baluster engagement portion 741 may include an upper portion 760 that may facilitate manual handing of the clip 700 during engagement with the rail 400 and rotation of the clip 700 relative to the rail 400. The upper portion 760 may be have a substantially rectangular cross-section with curved edges.

Figure 8:
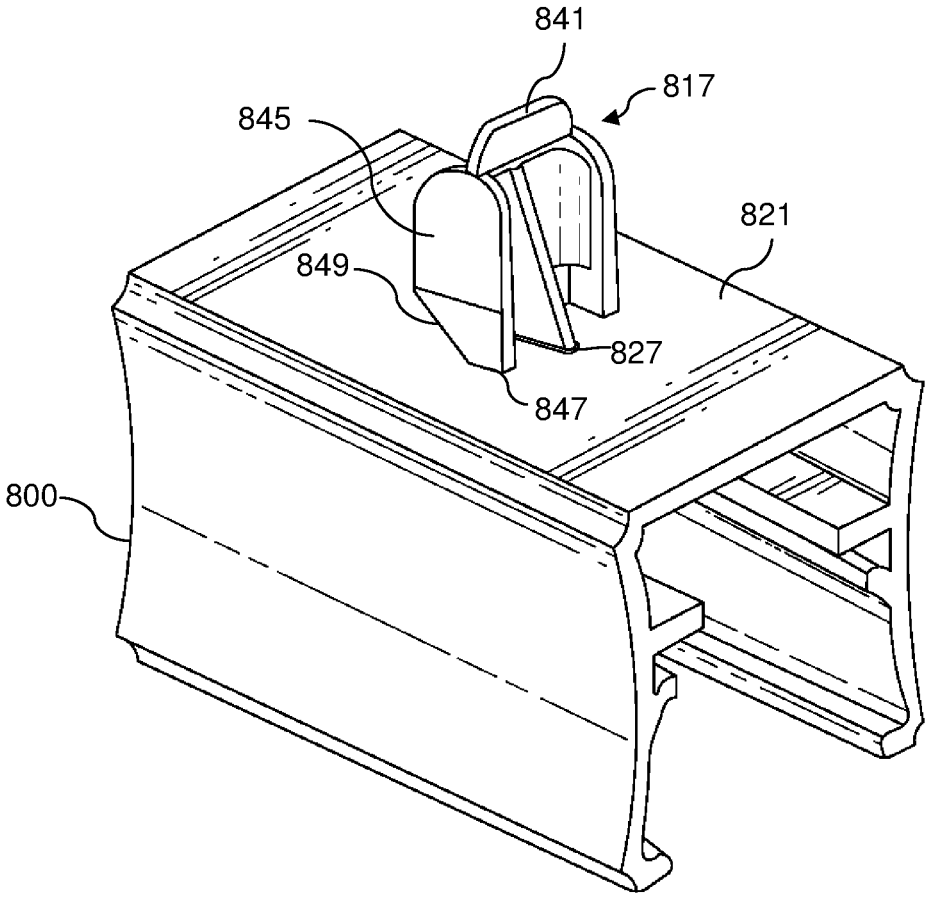
FIG. 8 illustrates a rail connected to a clip, in accordance with an embodiment of the present disclosure.

FIG. 8 illustrates a rail 800 and an inserted clip 817. As illustrated in FIG. 8, the clip 817 is inserted within an aperture 827 of the rail 800. The clip 817 is secured to the rail 800 at a first position that is perpendicular to a planar surface 821 of the rail 800. The clip 817 includes a baluster engagement portion 841 configured to couple a baluster (not shown in FIG. 8) to the rail 800. Further, the baluster engagement portion 841 also includes a pair of support portions 845. Each of the support portions 845 includes a first support surface 847 and a second support surface 849 configured to support the baluster engagement portion 841 on the planar surface 821. As illustrated in FIG. 8, the first support surface 847 supports the clip 817 on the planar surface 821 at the first position of the clip 817, i.e., when the clip 817 is perpendicular to the rail 800.

Figure 9:
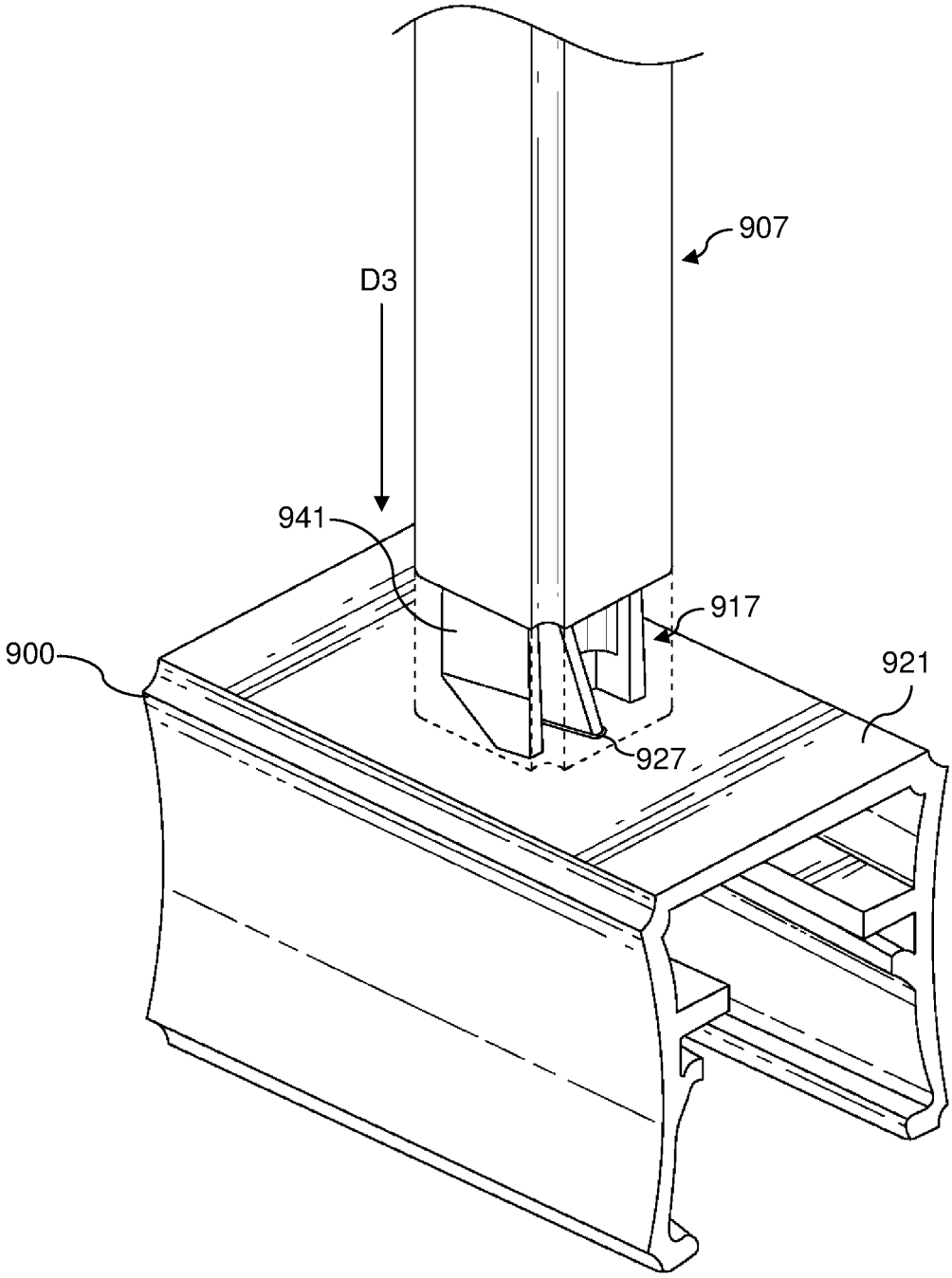
FIG. 9 illustrates the clip connecting a baluster to the rail, in accordance with an embodiment of the present disclosure.

FIG. 9 illustrates an insertion of a baluster 907 on an inserted clip 917. The clip 917 is coupled to a rail 900 by spring action of a spring portion (not shown in FIG. 9) of the clip 917. The baluster 907 is slid on the clip 917 along a direction "D3". The direction "D3" may be substantially perpendicular to a planar surface 921 of the rail 900. In some embodiments, the baluster 907 may be coupled to a baluster engagement portion 941 of the clip 917 via friction fit. In some other embodiments, the baluster 907 may be coupled to the baluster engagement portion by any other fastening methods, such as, but not limited to, an adhesive, one or more mechanical fasteners, and so forth. The baluster 907 may be substantially perpendicular to the planar surface 921 of the rail 900 upon coupling with the clip 917.

Figure 10:
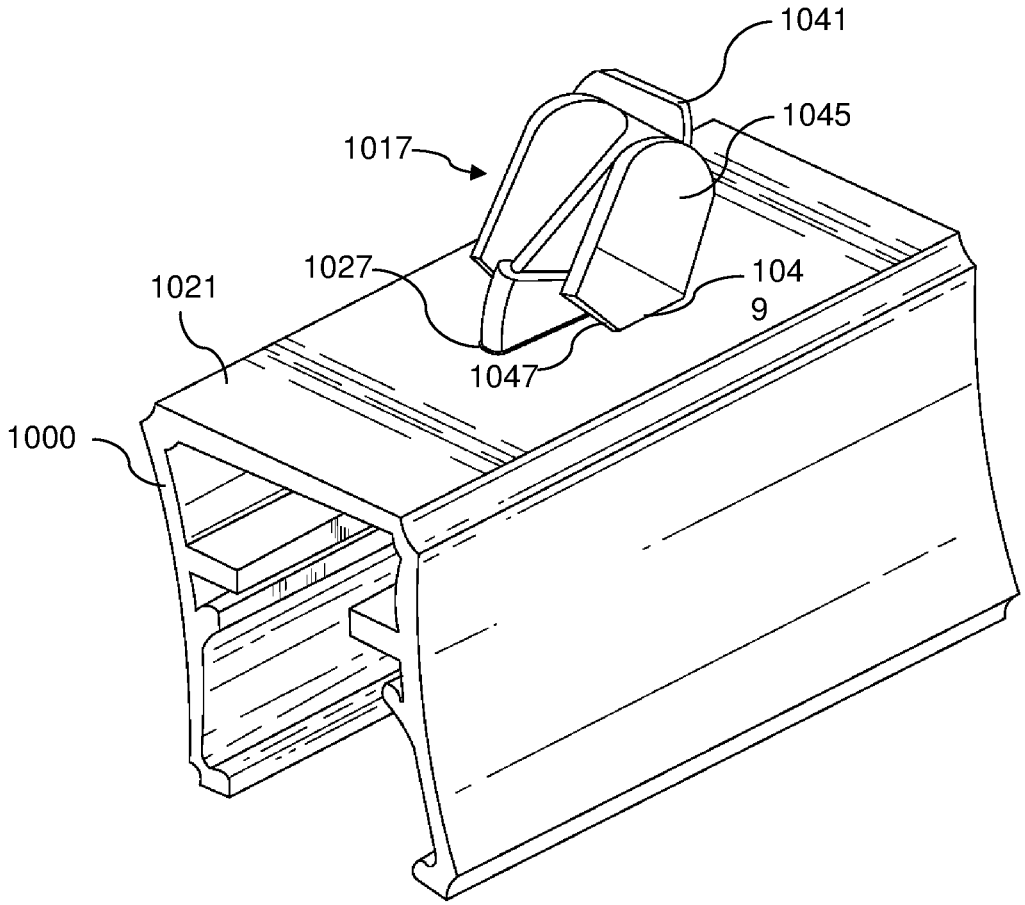
FIG. 10 illustrates a rail connected to a clip, in accordance with another embodiment of the present disclosure.

FIG. 10 illustrates a rail 1000 and an inserted clip 1017. The clip 1017 is inserted within an aperture 1027 of the rail 1000. The clip 1017 may be first secured to the rail 1000 at a first position that is perpendicular to a planar surface 1021 of the rail 1000. After securing the clip 1017 to the rail 1000, the clip 1017 may be rotated relative to the rail 1000 to a second position, as illustrated in FIG. 10. The clip 1017 includes a baluster engagement portion 1041 configured to couple a baluster (not shown in FIG. 10) to the rail 1000. Further, the baluster engagement portion 1041 also includes a pair of support portions 1045. Each of the support portions 1045 includes a first support surface 1047 and a second support surface 1049 configured to support the baluster engagement portion 1041 on the planar surface 1021. As illustrated in FIG. 10, the second support surface 1049 supports the clip 1017 on the planar surface 1021 at the second position, i.e., when the clip 1017 is inclined obliquely with respect to the rail 1000.

Figure 11:
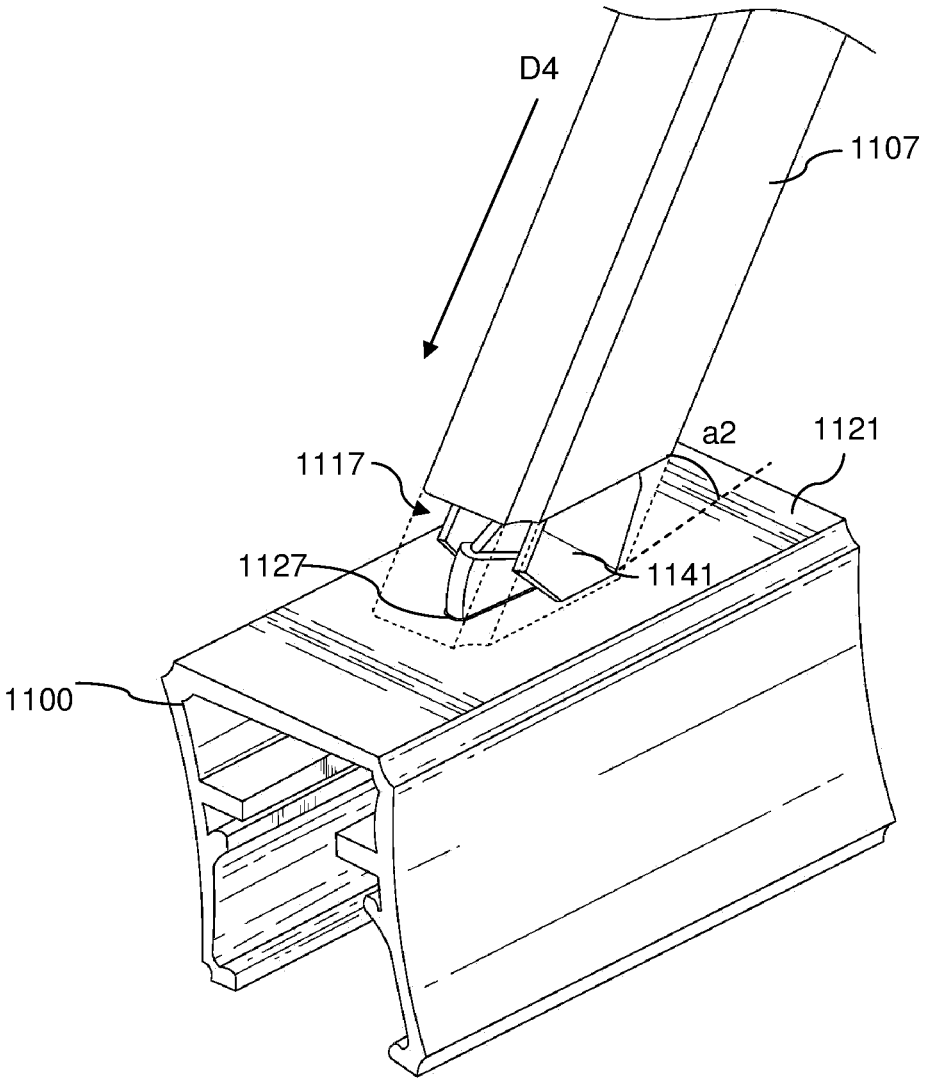
FIG. 11 illustrates the clip connecting a baluster to the rail, in accordance with another embodiment of the present disclosure.

FIG. 11 illustrates an insertion of a baluster 1107 on an inserted clip 1117. The clip 1117 is coupled to a rail 1100 by spring action of a spring portion (not shown in FIG. 11) of the clip 1117. The baluster 1107 is slid on the clip 1117 in a "D4" direction. The direction "D4" may be obliquely oriented relative to a planar surface 1121 of the rail 1100. In some embodiments, the baluster 1107 may be coupled to a baluster engagement portion 1141 of the clip 1117 via friction fit. In some other embodiments, the baluster 1107 may be coupled to the baluster engagement portion by any other fastening methods, such as, but not limited to, an adhesive, one or more mechanical fasteners, and so forth. The baluster 1107 may be at an angle "a2" to the planar surface 1121 of the rail 1100. In some embodiments, the angle "a2" may range between approximately 29 degrees to approximately 41 degrees relative to the rail 1100.

Figure 12A:
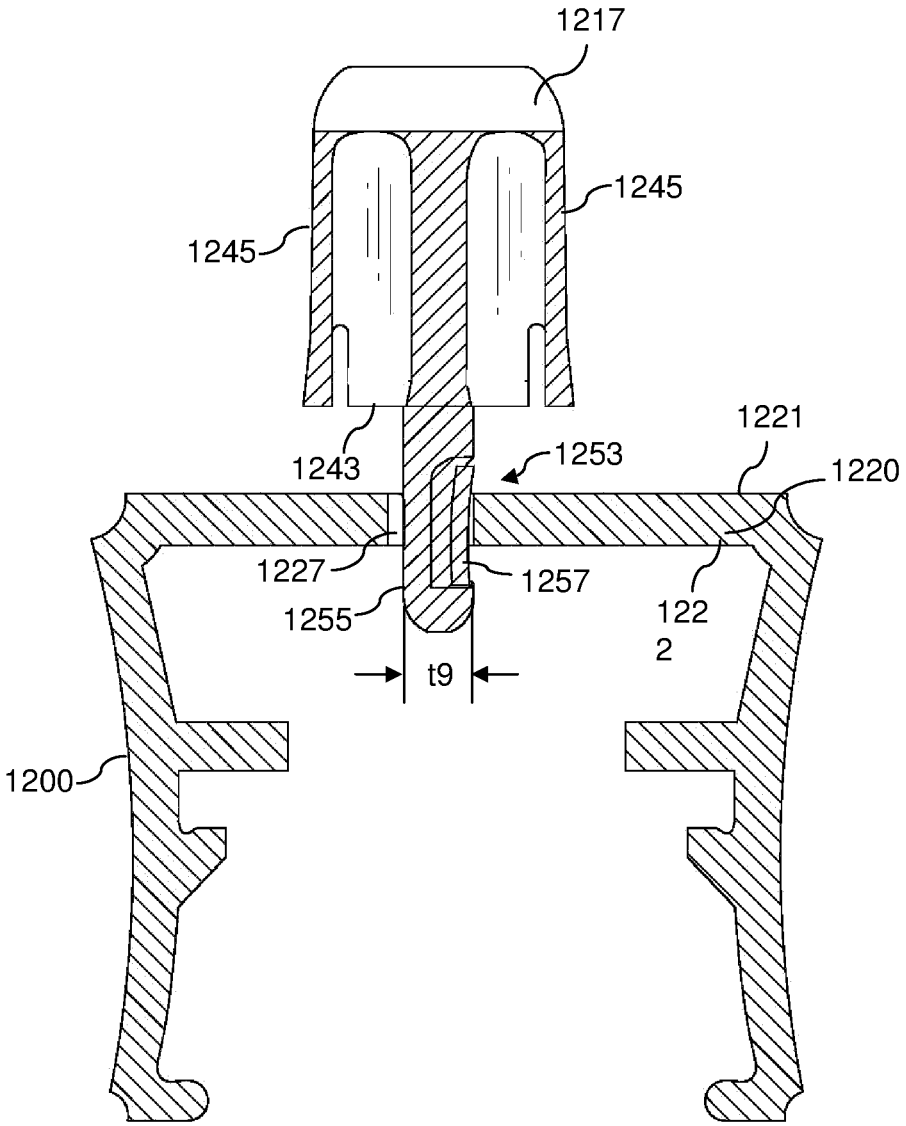
FIGS. 12A and 12B illustrate sectional views of a rail and a clip, in accordance with another embodiment of the present disclosure.
Figure 12B:
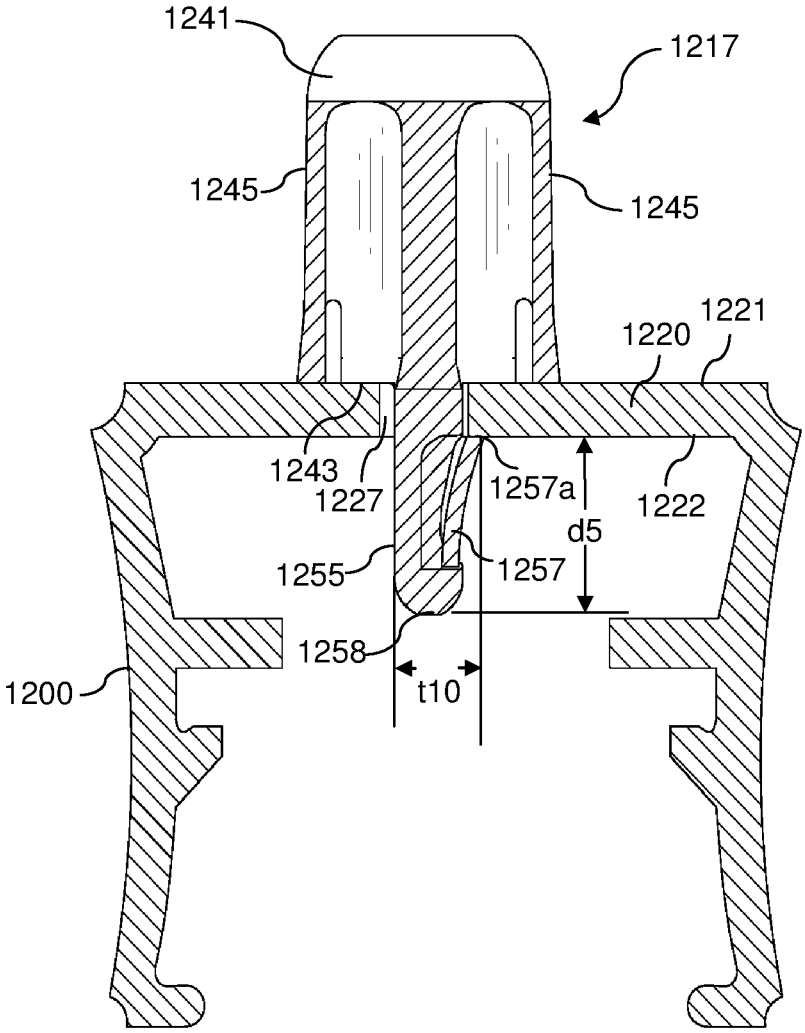

FIGS. 12A and 12B are sectional views illustrating insertion of a clip 1217 within an aperture 1227 of a rail 1200. The aperture 1227 and the rail 1200 may be similar to the aperture 427 and the rail 400, respectively, as shown in FIG. 4B. The rail 1200 includes a wall 1220 having a planar surface 1221 and a bottom surface 1222 opposite to the planar surface 1221. The wall 1220 also includes the aperture 1227. The clip 1217 includes a baluster engagement portion 1241. The baluster engagement portion 1241 includes a mounting surface 1243 configured to be seated on the planar surface 1221 of the rail 1200. The baluster engagement portion 1241 also includes a pair of support portions 1245 configured to support the baluster engagement portion 1241 on the planar surface 1221.

The clip 1217 further includes a tab 1253 extending from the baluster engagement portion 1241. The tab 1253 includes a fin portion 1255 and a spring portion 1257 coupled to the fin portion 1255. As illustrated in FIG. 12A, the spring portion 1257 deforms to provide a uniform thickness "t9" to the tab 1253. The uniform thickness "t9" is less than or approximately equal to the width "w1" (shown in FIG. 4B) of the aperture 427. The difference in widths may allow a smooth insertion of the tab 1253 within the aperture. Further, as illustrated in FIG. 12B, the spring portion 1257 returns to its normal state after insertion of the tab 1253 by a predetermined distance. The predetermined distance may be less than or equal to the height "h2" (shown in FIG. 4A) of rail 1200. Further, in an embodiment, the predetermined distance may be equal to a distance "d5", as shown in FIG. 12B. The distance "d5" may be substantially equal to a distance between an upper edge 1257*a* of the spring portion 1257 and a lower edge 1258 of the tab 1253. The tab 1253 may have a maximum thickness "t10" when the spring portion 1257 is in the normal state. The maximum thickness "t10" is greater than the width "w1, thereby preventing the clip 1217 from decoupling with the rail 1200. In some embodiments, the spring portion 1257 may touch the bottom surface 1222 of the planar surface 1221 after moving to the normal state. In some other embodiments, a clearance may be provided between the bottom surface 1222 and the spring portion 1257 to allow a smooth rotation of the clip 1217 with respect to the planar surface 1221.

Figure 13A:
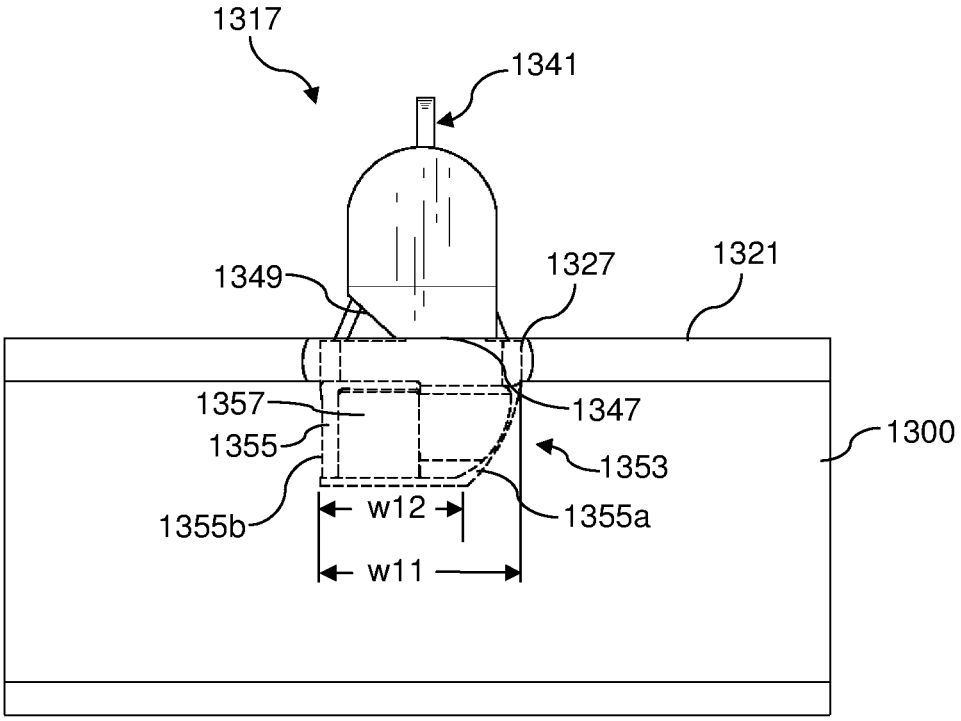
FIGS. 13A and 13B are side views of a clip coupled to a rail, in accordance with an embodiment of the present disclosure.
Figure 13B:
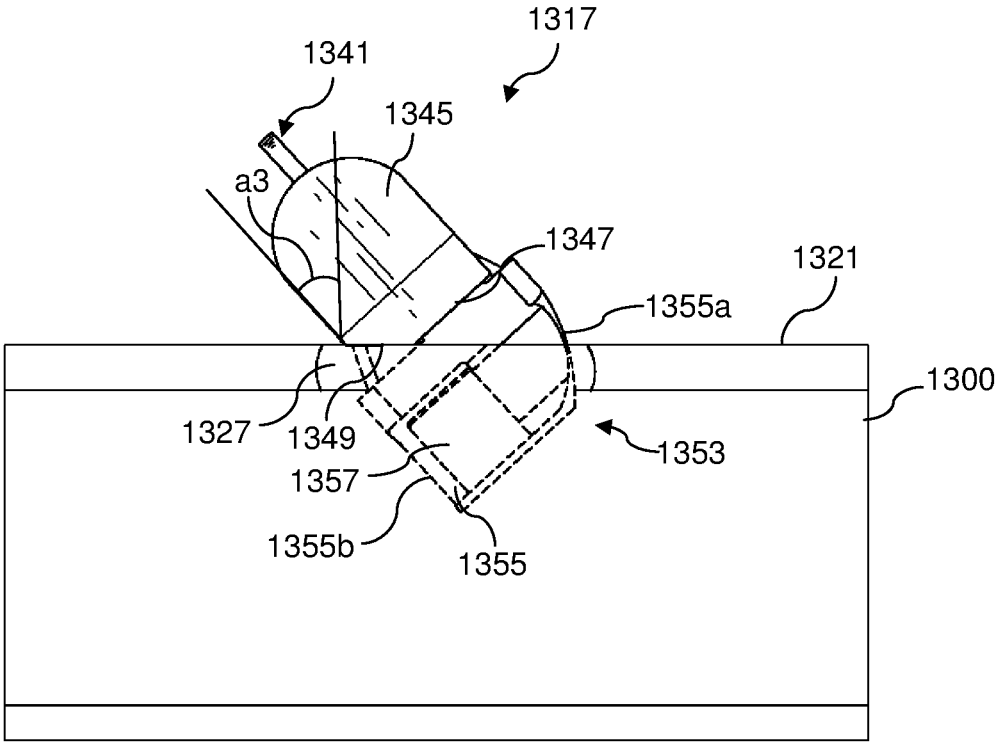

FIGS. 13A and 13B are side views illustrating a clip 1317 coupled to a rail 1300. The rail 1300 includes a planar surface 1321 with an aperture 1327. The aperture 1327 and the rail 1300 may be similar to the aperture 427 and the rail 400, respectively, as shown in FIG. 4B. The clip 1317 includes a baluster engagement portion 1341. The baluster engagement portion 1341 includes a pair of support portions 1345 configured to support the baluster engagement portion 1341 on the planar surface 1321. The support portion 1345 includes a first support surface 1347 configured to support the baluster engagement portion 1341 on the planar surface 1321. The support portion 1345 also includes a second support surface 1349 extending form the first support surface 1347. The second support surface 1349 is inclined with respect to the first support surface 1347.

The clip 1317 further includes a tab 1353 extending from the baluster engagement portion 1341. The tab 1353 includes a fin portion 1355. The fin portion 1355 has a first end surface 1355*a* and a second end surface 1355*b* opposite to the first end surface 1355*a*. In an exemplary embodiment, the first end surface 1355*a* has a curvilinear shape to allow rotation of the clip 1317 between a first position and a second position relative to the planar surface 1321. Further, the tab 1353 may have a variable width due to the curvilinear shape of the first end surface 1355*a*. However, the tab may have a maximum width "w11" proximate to the baluster engagement portion 1341 and a minimum width "w12" distal to the baluster engagement portion 1341. Further, the maximum width "w11" of the tab 1353 is less than or approximately equal to the length "l1" (shown in FIG. 4B) of the aperture 1327. As illustrated in FIG. 13A, the clip 1317 is positioned at a first position and supported by a first support surface 1347 on the planar surface 1321. The clip 1317 is substantially perpendicular to the planar surface 1321. FIG. 13B illustrates a rotation of the clip 1317 relative to the planar surface 1321 by an angle "a3". The angle of rotation "a3" is substantially equal to an angular difference between the first support surface 1347 and the second support surface 1349. Further, the curvilinear shape of the first end surface 1355*a* enables the rotation of the clip 1317 between the first position and the second position. Further, in both the first position and the second position, a spring portion 1357 of the tab 1353 may contact a bottom surface 1322 of the rail 1300 in order to prevent removal of the tab 1353 from the aperture 1327, thereby securing the clip 1317 to the rail 1300. As such, the spring portion 1357 is configured to be elastically moved between the deformed state (shown in FIG. 13A) and the normal state (shown in FIG. 13B) based on an extent of insertion of the tab 1353 within the aperture 1327.

Though the above embodiments are described with reference to a railing system and assembly, embodiments of the present disclosure are intended to cover any railing system having one or more rails with clips to couple one or more balusters. The clips may be easily coupled with corresponding rails, thereby enabling quick and simple assembly of the railing system.

The railing system, as disclosed by the present disclosure, can be advantageously combined or retrofitted with an existing railing system. A user can easily couple a baluster to a rail using a clip of the present disclosure. Further, the clip allows the coupling of the baluster and the rail for any railing system such as, but not limited to, a leveled railing system, an angled railing system, and so forth. Therefore, the user can assemble the railing system as per his or her preferences. Further, the baluster is not required to have an extra length to be inserted within the rail, which reduces overall cost of the railing system as well as shipping costs.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to a railing system. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights that include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A railing system comprising:

an upper rail comprising a planar surface, the planar surface comprising a plurality of apertures, the apertures each having a respective ridge;

a lower rail spaced from the upper rail and comprising a planar surface, the planar surface comprising a plurality of apertures, the apertures each having a respective ridge;

a plurality of balusters positioned between the upper rail and the lower rail; and a clip to attach one baluster of the plurality of balusters to the lower rail or to the upper rail, the clip comprising:

a baluster engagement portion inserted within an open end of the one baluster, the baluster engagement portion seated on the planar surface of the lower rail or the upper rail; and a tab extending from the baluster engagement portion, the tab comprising:

a rotatable fin portion rotatably inserted within one aperture of the plurality of apertures of the upper rail or the lower rail wherein the engagement portion is secured over the ridge, the fin portion having a first end surface and a second end surface opposite to the first end surface, wherein the first end surface has a curvilinear shape to allow rotation of the clip between a first rotated position and a second rotated position relative to the upper rail or the lower rail, and a spring portion coupled to the fin portion, wherein the spring portion extends partially between the first end surface and the second end surface so that the clip is rotatable between the first rotated position and the second rotated position, and wherein, upon insertion of the fin portion by at least a predetermined distance within the one aperture, the spring portion secures the clip to one of the upper rail and the lower rail, wherein the spring portion is elastically deformable between a normal state and a deformed state such that the spring portion is in the deformed state in the first rotated position of the clip and in the normal state in the second rotated position of the clip.

2. The railing system of claim 1, wherein each of the plurality of balusters is substantially perpendicular to the upper rail and the lower rail.

3. The railing system of claim 1, wherein each of the plurality of balusters is positioned at an angle of from about 29 degrees to about 41 degrees relative to the upper rail and the lower rail.

4. The railing system of claim 1, wherein the baluster engagement portion comprises a mounting surface seated on the planar surface of one of the upper rail and the lower rail in the first position of the clip, and wherein the mounting surface is inclined with respect to the planar surface in the second position of the clip.

5. The railing system of claim 4, wherein a width of the mounting surface is greater than a width of each of the plurality of apertures of the upper rail or the lower rail.

6. The railing system of claim 1, wherein the baluster engagement portion further comprises at least one support portion, wherein the at least one support portion comprises:

a first support surface to support the baluster engagement portion on the planar surface of the upper rail or the lower rail in the first position; and a second support surface extending from and inclined with respect to the first support surface, the second support surface to support the baluster engagement portion on the planar surface of the upper rail or the lower rail in the second position.

7. The railing system of claim 6, wherein the baluster engagement portion further comprises a recess between a mounting surface and the at least one support portion.

8. The railing system of claim 1, wherein the spring portion comprises a curvilinear shape.

9. The railing system of claim 1, wherein the fin portion extends from a mounting surface, the fin portion comprising:

an upper part located adjacent to the mounting surface;

a middle part extending from the upper part and having a curvilinear shape; and a lower part extending from the middle part, wherein the spring portion projects from the lower part towards the upper part.

10. A railing system comprising:

a rail comprising a planar surface, the planar surface comprising at least one aperture; and a clip to attach a baluster to the rail, the clip comprising:

a baluster engagement portion received within an open end of the baluster, the baluster engagement portion seated on the planar surface of the rail; and a tab extending from the baluster engagement portion, the tab comprising:

a rotatable fin portion rotatably inserted within the at least one aperture on the planar surface of the rail, the fin portion having a first end surface and a second end surface opposite to the first end surface, wherein the first end surface has a curvilinear shape to allow rotation of the clip between a first rotated position and a second rotated position relative to the rail, and wherein a middle part of the fin portion has a curvilinear shape and extends between the first end surface and the second end surface; and a spring portion coupled to the fin portion, wherein the spring portion forms a curvilinear shape and extends partially between the first end surface and the second end surface so that the clip is rotatable between the first rotated position and the second rotated position, in which the curvilinear shape of the middle part of the fin portion accommodates the curvilinear shape of the spring portion, and wherein, upon insertion of the fin portion by at least a predetermined distance within the at least one aperture, the spring portion secures the clip to the rail, wherein the spring portion is elastically deformable between a normal state and a deformed state such that the spring portion is in the deformed state in the first rotated position of the clip and in the normal state in the second rotated position of the clip.

11. The railing system of claim 10, wherein the baluster engagement portion comprises a mounting surface seated on the planar surface of the rail in the first position of the clip, and wherein the mounting surface is inclined with respect to the planar surface in the second position of the clip.

12. The railing system of claim 11, wherein a width of the mounting surface is greater than a width of the at least one aperture of the rail.

13. The railing system of claim 10, wherein the baluster engagement portion further comprises at least one support portion, the at least one support portion comprising:

a first support surface to support the baluster engagement portion on the planar surface of the rail in the first position; and a second support surface extending from and inclined with respect to the first support surface, the second support surface to support the baluster engagement portion on the planar surface of the rail in the second position.

14. The railing system of claim 10, wherein the baluster engagement portion further comprises a recess between a mounting surface and the at least one support portion.

15. The railing system of claim 10, wherein the fin portion extends from a mounting surface, the fin portion comprising:

an upper part located adjacent to the mounting surface;

the middle part extending from the upper part; and a lower part extending from the middle part, wherein the spring portion projects from the lower part towards the upper part.

16. A clip for attaching a baluster to a rail, the clip comprising:

a baluster engagement portion to be received within an open end of the baluster, the baluster engagement portion comprising a mounting surface to be seated on a planar surface of the rail; and a tab extending from the baluster engagement portion, the tab comprising:

a rotatable fin portion to be rotatably inserted within an aperture of the rail, the fin portion having a first end surface and a second end surface opposite to the first end surface, wherein the first end surface has a curvilinear shape to allow rotation of the clip between a first rotated position and a second rotated position relative to the rail, and a spring portion coupled to the fin portion, wherein the spring portion extends partially between the first end surface and the second end surface so that the clip is rotatable between the first rotated position and the second rotated position, and wherein, upon insertion of the fin portion by at least a predetermined distance within the aperture, the spring portion secures the clip to the rail wherein the spring portion is elastically deformable between a normal state and a deformed state such that the spring portion is in the deformed state in the first rotated position of the clip and in the normal state in the second rotated position of the clip.

17. The clip of claim 16, wherein the mounting surface is seated on the planar surface of the rail in the first position of the clip, and wherein the mounting surface is inclined with respect to the planar surface in the second position of the clip.

18. The clip of claim 17, wherein a width of the mounting surface is greater than a width of said aperture.

19. The clip of claim 16, wherein the fin portion extends from the mounting surface, the fin portion comprising:

an upper part located adjacent to the mounting surface;

a middle part extending from the upper part and having a curvilinear shape; and a lower part extending from the middle part, wherein the spring portion projects from the lower part towards the upper part.

* * * * *